US006527069B1

(12) United States Patent
Meiners et al.

(10) Patent No.: US 6,527,069 B1
(45) Date of Patent: Mar. 4, 2003

(54) SUPERABRASIVE CUTTER HAVING OPTIMIZED TABLE THICKNESS AND ARCUATE TABLE-TO-SUBSTRATE INTERFACES

(75) Inventors: Matthew J. Meiners, The Woodlands; Michael L. Doster, Spring, both of TX (US); Marcus R. Skeem, Orem; Arthur A. Chaves, Sandy, both of UT (US)

(73) Assignee: Baker Hughes Incorporated, Houston, TX (US)

( * ) Notice: Subject to any disclaimer, the term of this patent is extended or adjusted under 35 U.S.C. 154(b) by 96 days.

(21) Appl. No.: 09/671,323

(22) Filed: Sep. 26, 2000

Related U.S. Application Data

(63) Continuation-in-part of application No. 09/104,620, filed on Jun. 25, 1998, now Pat. No. 6,412,590, and a continuation-in-part of application No. 09/604,717, filed on Jun. 27, 2000.

(51) Int. Cl.[7] ..... E21B 10/46
(52) U.S. Cl. ..... 175/432
(58) Field of Search ..... 175/432, 431

(56) References Cited

U.S. PATENT DOCUMENTS

| | | | |
|---|---|---|---|
| 4,109,737 | A | 8/1978 | Bovenkerk |
| RE32,036 | E | 11/1985 | Dennis |
| 4,558,753 | A | 12/1985 | Barr |
| 4,593,777 | A | 6/1986 | Barr |
| 4,660,659 | A | 4/1987 | Short, Jr. et al. |
| 4,679,639 | A | 7/1987 | Barr et al. |
| 4,858,707 | A | 8/1989 | Jones et al. |
| 4,987,800 | A | 1/1991 | Gasan et al. |
| 4,997,049 | A | 3/1991 | Tank et al. |
| 5,016,718 | A | 5/1991 | Tandberg |
| 5,120,327 | A | 6/1992 | Dennis |
| 5,351,772 | A | 10/1994 | Smith |
| 5,355,969 | A | 10/1994 | Hardy et al. |
| 5,379,854 | A | 1/1995 | Dennis |
| 5,435,403 | A | 7/1995 | Tibbitts |
| 5,437,343 | A | 8/1995 | Cooley et al. |
| 5,460,233 | A | 10/1995 | Meany et al. |
| 5,472,376 | A | 12/1995 | Olmstead et al. |
| 5,484,330 | A | 1/1996 | Flood et al. |
| 5,486,137 | A | 1/1996 | Flood et al. |
| 5,494,477 | A | 2/1996 | Flood et al. |

(List continued on next page.)

FOREIGN PATENT DOCUMENTS

| | | | |
|---|---|---|---|
| GB | 2 300 208 | A | 10/1996 |
| GB | 2 316 698 | A | 4/1998 |

OTHER PUBLICATIONS

Search Report dated Oct. 19, 1999.

*Primary Examiner*—Hoang Dang
(74) *Attorney, Agent, or Firm*—TraskBritt

(57) ABSTRACT

A cutter and a drill bit having such cutters for drilling subterranean formations including a superabrasive table formed on an end face of a supporting substrate, there being an interface between the table and the end face including a topographic configuration including at least one, and preferably a plurality of, annular arcuate surfaces centered about the centerline of the cutter and at least one recessed region or groove extending across a substantial portion of the end face. The topographic configuration of the end face is of an orientation and radial width sufficient to accommodate resultant loading of the cutting edge of the cutter throughout a variety of angles with vectors normal to the surface at a variety of angles such that at least one normal vector is aligned substantially parallel to the resultant loading on the cutting edge. The topographic configuration of the end face, preferably including at least one recessed portion, further provides a cutter in which the superabrasive table and the substrate are less prone to cracking, spalling, and catastrophic failure.

51 Claims, 17 Drawing Sheets

U.S. PATENT DOCUMENTS 5,499,688 A 3/1996 Dennis
5,544,713 A 8/1996 Dennis
5,590,728 A 1/1997 Matthias et al.
5,590,729 A 1/1997 Cooley et al.
5,605,199 A 2/1997 Newton
5,617,928 A 4/1997 Matthias et al.
5,647,449 A 7/1997 Dennis
5,649,604 A 7/1997 Fuller et al.
5,706,906 A 1/1998 Jurewicz et al.
5,709,279 A 1/1998 Dennis
5,711,702 A 1/1998 Devlin
5,758,733 A 6/1998 Scott et al.
5,823,277 A 10/1998 Delwiche et al.
5,862,873 A 1/1999 Matthias et al.
5,871,060 A 2/1999 Jensen et al.
5,887,580 A 3/1999 Eyre
5,890,552 A 4/1999 Scott et al.
5,906,246 A 5/1999 Mensa-Wilmot et al.
5,928,071 A * 7/1999 Devlin ..... 175/428
5,971,087 A 10/1999 Chaves
6,003,623 A * 12/1999 Miess ..... 175/426
6,026,919 A 2/2000 Thigpen et al.
6,041,875 A 3/2000 Rai et al.
6,065,554 A 5/2000 Taylor et al.
6,068,071 A * 5/2000 Jurewicz ..... 175/432
6,082,474 A * 7/2000 Matthias ..... 175/432
6,135,219 A 10/2000 Scott
6,189,634 B1 * 2/2001 Bertagnolli et al. ..... 175/432
6,196,340 B1 3/2001 Jensen et al.
6,199,645 B1 * 3/2001 Anderson et al. ..... 175/426
6,202,771 B1 * 3/2001 Scott et al. ..... 175/430
6,227,319 B1 * 5/2001 Radford ..... 175/431
6,315,067 B1 * 11/2001 Fielder ..... 175/432

* cited by examiner

SUPERABRASIVE CUTTER HAVING OPTIMIZED TABLE THICKNESS AND ARCUATE TABLE-TO-SUBSTRATE INTERFACES

CROSS-REFERENCES TO RELATED PATENT APPLICATION

This is a continuation-in-part application of co-pending U.S. patent application having Ser. No. 09/104,620 filed on Jun. 25, 1998, and also is a continuation-in-part application of co-pending U.S. patent application Ser. No. 09/604,717 filed on Jun. 27, 2000.

BACKGROUND OF THE INVENTION

1. Field of the Invention

The present invention relates generally to rotary bits for drilling subterranean formations and, more specifically, to superabrasive cutting elements or cutters suitable for use on such bits, particularly of the so-called fixed-cutter or "drag" bit variety.

2. Background of Related Art

Fixed-cutter or drag bits have been employed in subterranean drilling for many decades, and various sizes, shapes and patterns of natural and synthetic diamonds have been used on drag bit crowns as cutting elements. Polycrystalline diamond compact (PDC) cutters comprised of a diamond table formed under ultra-hightemperature, ultrahigh-pressure conditions onto a substrate, typically of cemented tungsten carbide (WC), were introduced about twenty-five years ago. PDC cutters, with their diamond tables providing a relatively large, two-dimensional cutting face (usually of circular, semicircular or tombstone shape, although other configurations are known), have provided drag bit designers with a wide variety of potential cutter deployments and orientations, crown configurations, nozzle placements and other design alternatives not previously possible with the smaller natural diamond and polyhedral, unbacked synthetic diamonds previously employed in drag bits. The PDC cutters have, with various bit designs, achieved outstanding advances in drilling efficiency and rate of penetration (ROP) when employed in soft to medium hardness formations, and the larger cutting face dimensions and attendant greater extension or "exposure" above the bit crown have afforded the opportunity for greatly improved bit hydraulics for cutter lubrication and cooling and formation debris removal. The same type and magnitude of advances in drag bit design in terms of cutter robustness and longevity, particularly for drilling rock of medium to high compressive strength, has, unfortunately, not been realized to a desired degree.

State of the art substrate-supported PDC cutters have demonstrated a notable susceptibility to spalling and fracture of the PDC diamond layer or table when subjected to the severe downhole environment attendant to drilling rock formations of moderate to high compressive strength, on the order of nine to twelve kpsi and above, unconfined. Engagement of such formations by the PDC cutters occurs under high weight on bit (WOB) required to drill such formations and high impact loads from torque oscillations. These conditions are aggravated by the periodic high loading and unloading of the cutting elements as the bit impacts against the unforgiving surface of the formation due to drill string flex, bounce and oscillation, bit whirl and wobble, and varying WOB. Thus, high compressive strength rock, or softer formations containing stringers of a different, higher compressive strength, may produce severe damage to, if not catastrophic failure of, the PDC diamond tables.

Furthermore, bits are subjected to severe vibration and shock loads induced by movement during drilling between rock of different compressive strengths, for example, when the bit abruptly encounters a moderately hard strata after drilling through soft rock.

Severe damage to even a single cutter on a PDC cutter-laden bit crown can drastically reduce efficiency of the bit. If there is more than one cutter at the radial location of a failed cutter, failure of one may soon cause the others to be overstressed and to fail in a "domino" effect. As even relatively minor damage may quickly accelerate the degradation of the PDC cutters, many drilling operators lack confidence in PDC cutter drag bits for hard and stringer-laden formations.

It has been recognized in the art that the sharp, typically 90° edge of an unworn, conventional PDC cutter element is especially susceptible to damage during its initial engagement with a hard formation, particularly if that engagement includes even a relatively minor impact. It has also been recognized that pre-beveling or pre-chamfering of the PDC diamond table cutting edge provides some degree of protection against cutter damage during initial engagement with the formation, the PDC cutters being demonstrably less susceptible to damage after a wear flat has begun to form on the diamond table and substrate.

U.S. Pat. Nos. Re 32,036, 4,109,737, 4,987,800, and 5,016,718 disclose and illustrate beveled or chamfered PDC cutting elements, as well as alternative modifications such as rounded (radiused) edges and perforated edges which fracture into a chamfer-like configuration. U.S. Pat. No. 5,437,343, assigned to the assignee of the present application and incorporated herein by this reference, discloses and illustrates a multiple-chamfer PDC diamond table edge configuration which, under some conditions, exhibits even greater resistance to impact-induced cutter damage. U.S. Pat. No. 5,706,906, assigned to the assignee of the present application and incorporated herein by this reference, discloses and illustrates PDC cutters employing a relatively thick diamond table and a very large chamfer, or so-called "rake land", at the diamond table periphery.

However, even with the PDC cutting element edge configuration modifications employed in the art, cutter damage remains an all too frequent occurrence when drilling formations of moderate to high compressive strengths and stringer-laden formations.

Another approach to enhancing the robustness of PDC cutters has been the use of variously configured boundaries or "interfaces" between the diamond table and the supporting substrate. Some of these interface configurations are intended to enhance the bond between the diamond table and the substrate, while others are intended to modify the types, concentrations and locations of stresses (compressive, tensile) resident in the diamond tables and substrates as a result of the cutter being formed in an ultra high-pressure, ultra high-temperature process. Such residual stresses, as known in the art, are prone to arise because the diamond table typically has a lower coefficient of thermal expansion than that of the substrate to which it is cojoined. Additionally, the diamond table and substrate will typically have differing values of bulk modulus, thereby compounding the likelihood of residual stress being present in the cutter. As a newly formed cutter cools from the elevated temperature required to form the cutter, the residual stresses in the cutter tend to be especially concentrated at and near the interface where the diamond or superabrasive table is disposed upon the supportive substrate. Thus, depending on cutter construction, the direction and magnitude of such residual stresses may, and often do, cause the diamond table or superabrasive layer to prematurely fracture, delaminate, and/or spall as compared to cutters in which residual stresses are fortuitously of lesser magnitude or in which the residual stresses by chance happen to be oriented favorably.

Many attempts have been made to provide PDC cutters which are resistant to premature failure. The use of an interfacial transition layer with material properties intermediate of those of the diamond and substrate is known within the art. The formation of cutters with noncontinuous grooves or recesses in the substrate filled with diamond is also practiced, as are cutter formations having concentric circular grooves or a spiral groove.

The patent literature reveals a variety of cutter designs in which the diamond/substrate interface is three-dimensional, i.e., the diamond layer and/or substrate have portions which protrude into the other member to "anchor" it therein. The shape of these protrusions may be planar or arcuate, or combinations thereof U.S. Pat. No. 5,351,772 to Smith shows various patterns of radially directed interfacial formations on the substrate surface, the formations projecting into the diamond surface.

As shown in U.S. Pat. No. 5,486,137 to Flood et al., the interfacial diamond surface has a pattern of unconnected radial members which project into the substrate, the thickness of the diamond layer decreasing toward the central axis of the cutter. U.S. Pat. No. 5,590,728 to Matthias et al. describes a variety of interface patterns in which a plurality of unconnected straight and arcuate ribs or small circular areas characterize the diamond/substrate interface.

U.S. Pat. No. 5,605,199 to Newton teaches the use of ridges at the interface which are parallel or radial, with an enlarged circle of diamond material at the periphery of the interface.

In U.S. Pat. No. 5,709,279 to Dennis, the diamond/substrate interface is shown to be a repeating sinusoidal surface about the axial center of the cutter.

U.S. Pat. No. 5,871,060 to Jensen et al., assigned to the assignee hereof shows cutter interfaces having various ovaloid or round projections. The interface surface is indicated to be regular or irregular and may include surface grooves formed during or following sintering. A cutter substrate is depicted having a rounded interface surface with a combination of radial and concentric circular grooves formed in the interface surface of the substrate.

Still other interface configurations are dictated by other objectives, such as particular, desired cutting face topographies. Additional interface configurations are employed in so-called cutter "inserts" used on the rotatable cones of rock bits.

Other examples of a variety of interface configurations may be found, by way of example only, in U.S. Pat. Nos. 4,109,737, 4,858,707, 5,351,772, 5,460,233, 5,484,330, 5,486,137, 5,494,477, 5,499,688, 5,544,713, 5,605,199, 5,657,449, 5,706,906 and 5,711,702.

While cutting faces have been designed with features to accommodate and direct forces imposed on PDC cutters, see, for example, above-referenced U.S. Pat. No. 5,706,906, state-of-the-art PDC cutters have, to date, failed to adequately accommodate such forces at the diamond table-to-substrate interface, resulting in a susceptibility to spalling and fracture in that area. While the magnitude and direction of such forces might, at first impression, seem to be predictable and easily accommodated based upon cutter back rake and WOB, such is not the case, due to the variables encountered during a drilling operation previously noted herein. Therefore, it would be desirable to provide a PDC cutter having a table/substrate interface able to accommodate the wide swings in both magnitude and direction of forces encountered by PDC cutters during actual drilling operations, particularly in drilling formations of medium to high compressive strength rock, or containing stringers of such rock, while at the same time providing a superior, reliable mechanical connection between the diamond and substrate and sufficient diamond volume across the cutting face for extending the service life of the cutter, enabling more efficient and cost-effective drilling of boreholes in subterranean formations.

BRIEF SUMMARY OF THE INVENTION

The present invention addresses the requirements stated above, and includes PDC cutters having an optimized table thickness and an enhanced diamond table-to-substrate interface, as well as drill bits so equipped.

The cutters of the present invention, while having demonstrated utility in the context of PDC cutters, encompass any cutters employing superabrasive material of other types, such as thermally stable PDC material and cubic boron nitride compacts. The inventive cutters may be said to comprise, in broad terms, cutters having a superabrasive table formed on and mounted to a supporting substrate. Again, while a cemented WC substrate may be usually employed, substrates employing other materials in addition to, or in lieu of, WC may be employed in the invention.

Cutters embodying the present invention comprise a superabrasive table formed of a volume of superabrasive material and exhibit a two-dimensional, circular cutting face mounted or cojoined to an end face of a generally cylindrical-shaped substrate. An interface between the end face of the substrate and the volume of superabrasive material includes at least one generally annular arcuate surface of substrate material which is defined, in cross-section taken across and parallel to the longitudinal axis of the cutter, by an arc and further includes at least one radially recessed portion, extending radially across the interface between the substrate and the superabrasive volume. The generally annular surface of the substrate preferably comprises a first spherical or spheroidal surface of revolution having a first radius of curvature and is generally centered about, or coincident with, the longitudinal axis or centerline of the cutter to form a convex surface generally in the center portion of the end face. The first spherical or convex surface of revolution is preferably radially adjacent and bounded at its periphery by another, second surface of revolution having a second radius of curvature. The second surface of revolution is preferably a portion of a toroid which provides a concave surface generally coincident to the longitudinal axis of the cutter and generally surrounds the periphery of the first spherical surface of revolution. Preferably, the concave surface is contiguous with the first spherical surface of revolution. The toroid, in which a portion thereof defines the concave surface, is defined by a second radius extending from a centerpoint radially offset from the longitudinal centerline. Radially adjacent and surrounding the periphery of the second surface of revolution is a third surface of revolution having a third radius of curvature. The third surface of revolution is preferably a portion of a second toroid which provides a radially outermost and uppermost convex surface with respect to the longitudinal centerline. The third surface of revolution is radially bounded by, and preferably contiguous with, a generally downwardly extending, radially inset annular side wall. The side wall may be generally planar and generally perpendicular with the longitudinal centerline or it may contain at least one annular chamfered portion preferably located longitudinally adjacent the third surface of revolution. The radially inset side wall intersects, and is preferably contiguous with, a circumferential rim, shoulder, or annular ledge and preferably is provided with radiused curvature at such intersection to minimize the possibility of localized stress concentrations arising thereabout. The annular ledge, shoulder, or circumferential rim is preferably generally perpendicular to the longitudinal centerline and extends radially outward to intersect a generally circular-shaped radially outermost side wall, as viewed from above, defining the radially outermost extent of the substrate.

In one embodiment, the radially extending recessed portion generally diametrically bisects a substantial portion of the interface surface by extending from one position of the radially outermost curved surface to another diametrically opposite position of the radially outermost curved surface and preferably terminates at the circumferential rim.

In another embodiment of the inventive cutter, the end face of the substrate includes a second recessed region or groove preferably bisecting the first recessed region or groove at the longitudinal centerline. The second groove is preferably oriented to be generally perpendicular to the first groove and is generally of the same configuration and dimensions.

In yet another embodiment of the inventive cutter, an end face having at least one larger recessed portion is provided with a plurality of circumferentially spaced smaller, second radially extending recessed portions. The plurality of second, smaller recessed portions preferably originate radially beyond the first surface of revolution and terminate short of the circumferential rim or annular ledge surface. Preferably, the plurality of second smaller recessed portions are of a lesser width and length than the at least one first larger recessed region.

A volume of superabrasive material is formed over the substrate end face in using high-temperature, high-pressure processes known within the art and preferably has a maximum thickness approaching or exceeding 0.160 of an inch with an initial minimum thickness of at least approximately 0.090 of an inch. However, other minimum and maximum table thicknesses can be used in accordance with the present invention. The volume of superabrasive material conforms thereto along the interface, including filling any recessed regions therein, and thereby forms a superabrasive table. The exterior surface of the table may be provided with features such as annular chamfers as are conventional and known in the art.

The surface of the substrate end face, by virtue of its generally arcuate cross-sectional configuration in combination with at least one traversely extending recessed portion, or alternatively, at least one traversely extending raised portion, provides an interface designed to address multidirectional resultant loading of the cutting edge at the periphery of the cutting face of the superabrasive table. In general, resultant loads at the cutting edge are directed at an angle with respect to the longitudinal axis or centerline of the cutter which varies between about 20° and about 70°. The arcuate surface is designed so that a normal vector to the substrate material will lie parallel to, and opposing, the force vector loading the cutting edge of the cutter. Stated another way, since the angle of cutting edge loading varies widely, the arcuate surface presents a range of normal vectors to the resultant force vector loading the cutting edge so that at least one of the normal vectors will, at any given time and under any anticipated resultant loading angle, be parallel and in opposition to the loading. Thus, at the area of greatest stress experienced at the interface, the superabrasive material and adjacent substrate material will be in compression, and the interface surface will lie substantially transverse to the force vector, beneficially dispersing the associated stresses and avoiding any shear stresses.

Additionally, the at least one recessed region provided in the end face of the substrate, upon being filled with a superabrasive material, provides an enhanced heat transfer mechanism in which heat may be more efficiently conducted away from the cutting edge and the wear flat that typically forms on a portion of the radially outermost side wall and on a peripheral portion of the top face of the superabrasive table. Such an interface configuration, including a superabrasive material-filled recessed region or groove, tends to inhibit the formation of thermally induced cracks in the superabrasive table as well as the supporting substrate.

DETAILED DESCRIPTION OF THE INVENTION

Figure 1:
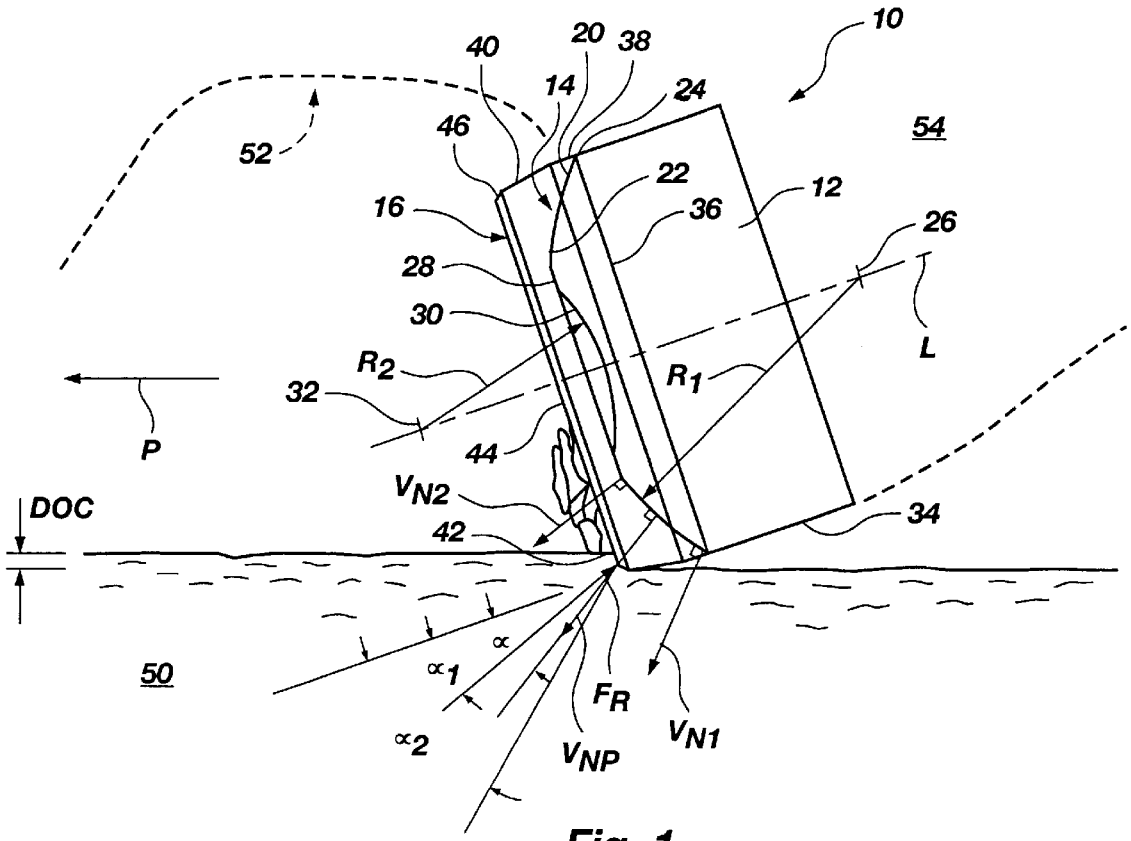
FIG. 1 is a side elevation of a first embodiment of a superabrasive cutter according to the present invention.

Referring to FIG. 1 of the drawings, a first embodiment 10 of the inventive cutter will be described. Cutter 10 includes a substrate 12 having an end face 14 on which a superabrasive table, such as a polycrystalline diamond compact (PDC) table 16, is formed. Substrate 12 is shown in side elevation with table 16 thereon shown as transparent (rather than in cross-section, with hatching) for clarity in explaining the structure and advantages of the invention in detail, although those of ordinary skill in the art will appreciate that the superabrasive material, such as a PDC, is opaque.

Substrate 12 is substantially cylindrical in shape, of a constant radius about centerline or longitudinal axis L. End face 14 of substrate 12 includes annular surface 20 comprising a spherical surface of revolution of radius $R_1$ having an inner circular periphery 22 and an outer circular periphery 24, the center point of the sphere being located at 26, coincident with centerline or longitudinal axis L. The inner periphery 22 abuts a flat annular surface 28 extending transverse to centerline or longitudinal axis L, while the concave center 30 of substrate end face 14 comprises another spherical surface of revolution of radius $R_2$ about center point 32, again coincident with centerline or longitudinal axis L. Superabrasive table 16 overlies end face 14 and is contiguous therewith, extending to side wall 34 of substrate 12 and defining a linear exterior boundary 36 therewith. Cylindrical side wall 38 of table 16, of the same radius of substrate 12, lies above boundary 36 and extends to inwardly tapering frustoconical sidewall 40, which terminates at cutting edge 42 at the periphery of cutting face 44. As shown, cutting edge 42 is chamfered at 46 as known in the art, although this is not a requirement of the invention. Typically, however, a nominal 0.010 inch (about 0.25 mm) depth, 45° angle chamfer may be employed. Larger or smaller chamfers may also have utility, depending upon the relative hardness of the formation or formations to be drilled, and the need to employ chamfer surfaces of a given cutter or cutters to enhance bit stability as well as cut the formation. Cutter 10 is shown in FIG. 1 oriented with respect to a formation 50, as it would be conventionally oriented on the face 52 of bit 54 (both shown in broken lines for clarity) during drilling, with cutting face 44 oriented generally transverse to the direction of cutter travel as the bit rotates and the cutter traverses a shallow helical path as the bit drills ahead into the formation. Also as is conventional, cutter 10 is oriented so that the cutting face 44 exhibits a negative back rake toward formation 50, leaning backward with respect to the direction of cutter travel from a line perpendicular to the path P of cutter travel through the formation 50.

As cutter 10 travels ahead and engages the formation to a depth of cut (DOC) dependent upon WOB and formation characteristics, cutter 10 is loaded at cutting edge 42 by a resultant force $F_R$, which is dependent upon WOB and torque applied to the drill bit, the latter being a function of bit rotational speed, DOC and formation hardness. As previously mentioned, instantaneous WOB, rotational speed and DOC may fluctuate widely, resulting not only in substantial changes in magnitude of $F_R$, but also in the angle a thereof, relative to longitudinal cutter axis L. As noted above, under most drilling conditions and even under the widest variation in drilling parameters and cutter back rakes, angle a varies in a range between an $\alpha_1$ of about 20° and an $\alpha_2$ of about 70°. As can readily be seen in FIG. 1, annular surface 20, comprising the aforementioned spherical surface of revolution, lies in an area where forces acting on the cutter 10 are greatest, and presents a surface orientation facing $F_R$ so that normal vectors to surface 20 are oriented over a range $V_{N1}$ through $V_{N2}$, within which range there is at least one normal vector $V_{NP}$, which is parallel to and coincident with, or only minutely offset from, $F_R$ at any given instant in time. This load-accommodating topography of surface 20 thus distributes $F_R$ in an area of substrate end face 14 substantially perpendicular to $F_R$. It is also notable that the area of end face 14 lying within annular surface 20 is configured with annular surface 28 and concave recess 30 to provide a substantial superabrasive material depth for table 16 and also an effective mechanical interlock along the interface between table 16 and substrate 12. Moreover, the presence of annular surface 20, dictating an increasing depth of superabrasive material as the table 16 approaches its periphery, generates a beneficial residual (from fabrication) compressive stress concentration in the area of the table periphery where cutter loading is greatest and provides a large volume of superabrasive material in the area of contact with the formation to minimize cutter wear.

Figure 2:
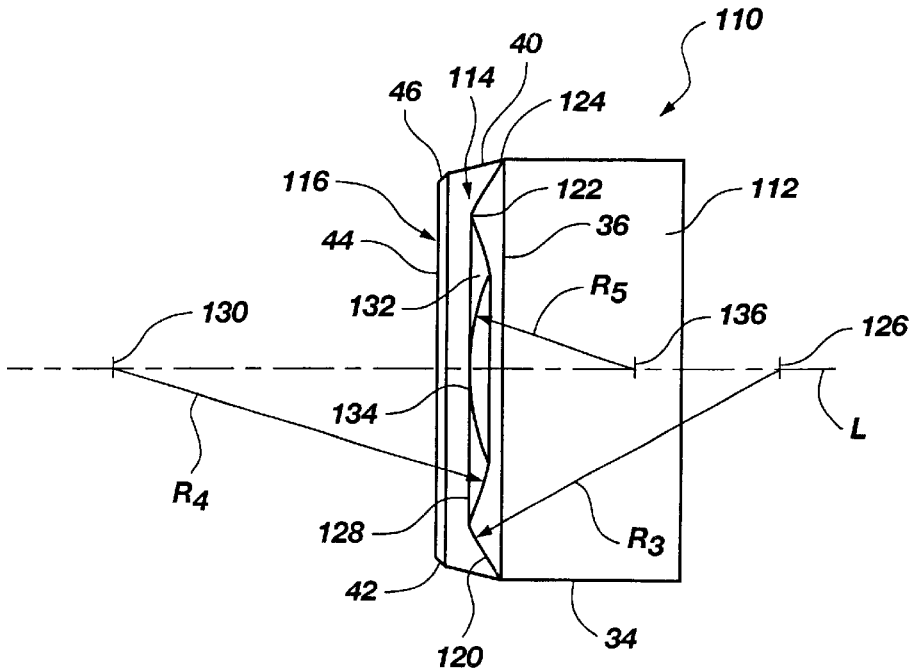
FIG. 2 is a side elevation of a second embodiment of a superabrasive cutter according to the present invention.

Referring to FIG. 2, another embodiment 110 of the cutter of the invention will be described. Features of cutter 10 also incorporated in cutter 110 are identified by the same reference numerals for clarity. Cutter 110 includes a substrate 112 having an end face 114 on which a superabrasive table, such as a polycrystalline diamond compact (PDC) table 116, is formed. Substrate 112 is shown in side elevation with table 116 thereon shown as transparent (rather than in cross-section, with hatching) for clarity in explaining the structure and advantages of the invention in detail, although those of ordinary skill in the art will appreciate that the superabrasive material, such as a PDC, is opaque.

Substrate 112 is substantially cylindrical in shape, of a constant radius about longitudinal axis or centerline L. End face 114 of substrate 112 includes annular surface 120 comprising a spherical surface of revolution of radius $R_3$ having an inner circular periphery 122 and an outer circular periphery 124, the center point of the sphere being located at 126, coincident with longitudinal axis or centerline L. The inner periphery 122 abuts another annular surface 128 comprising a spherical surface of revolution of radius $R_4$, the center point of the sphere being located at 130, coincident with longitudinal axis L. The inner periphery 132 of surface 128 abuts yet another arcuate, spherical surface of revolution 134, of radius $R_5$ about center point 136, coincident with longitudinal axis or centerline L. It should be noted that the uppermost portion of surface 134 is at the same elevation as inner periphery 122 of surface 120, although this is not a requirement of the invention.

Superabrasive table 116 overlies end face 114 and is contiguous therewith, extending to side wall 34 of substrate 112 and defining a linear exterior boundary 36 therewith. Inwardly tapering frustoconical sidewall 40 of table 116 commences adjacent boundary 36 and is of the same radius as substrate 112, extending above boundary 36 to cutting edge 42 at the periphery of cutting face 44. As shown, cutting edge 42 is chamfered at 46 as known in the art, although this is not a requirement of the invention.

As with cutter 10, it will be readily appreciated that annular surface 120 of end face 114 of substrate 112 of cutter 110 will provide a range of normal vectors sufficient to accommodate the range of orientations of resultant force loads acting on cutter 110 proximate cutting edge 42 during a drilling operation and distribute them over an area of end face lying substantially transverse to the loads. Again as with cutter 10, it will be appreciated that a substantial depth of superabrasive material is retained for table 116, and that a mechanically effective, symmetrical interlocking arrangement is provided at the interface between table 116 and substrate 112.

Figure 3A:
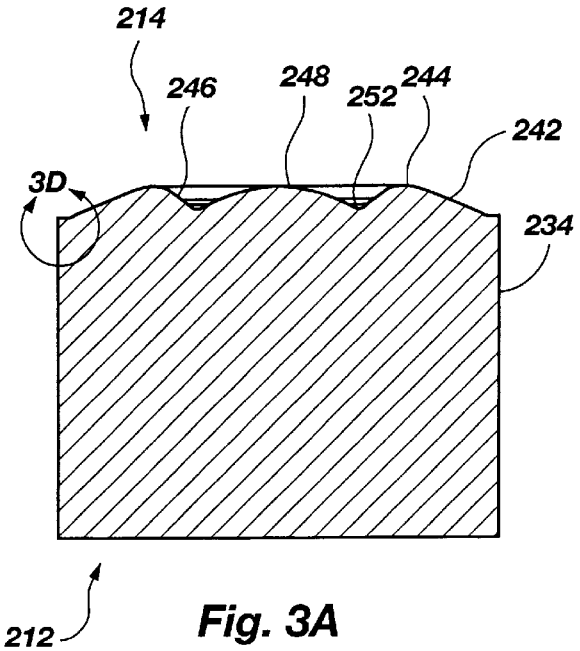
FIG. 3A is a side half-sectional elevation of a supporting substrate having utility in a third embodiment of a superabrasive cutter according to the present invention.
Figure 3B:
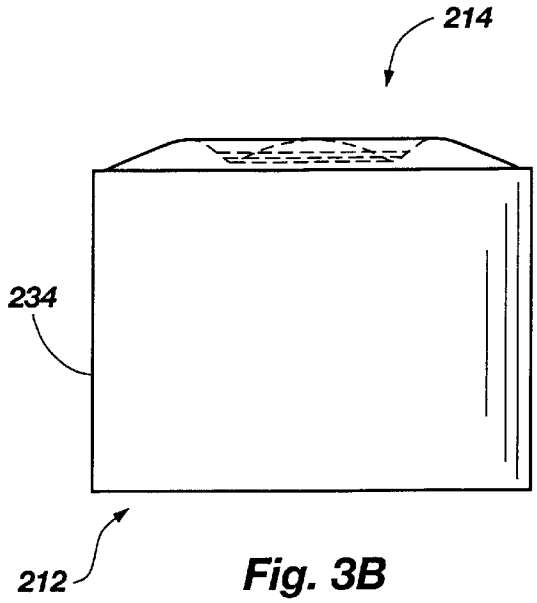
FIG. 3B is a side elevation of the substrate of FIG. 3A.
Figure 3C:
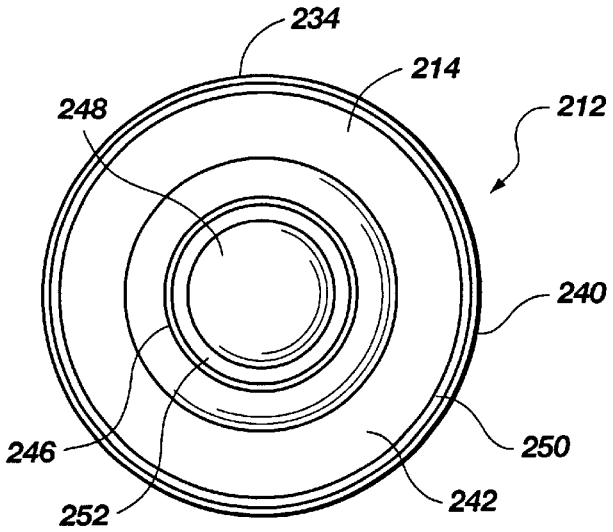
FIG. 3C is a top elevation of the substrate of FIG. 3A.
Figure 3D:
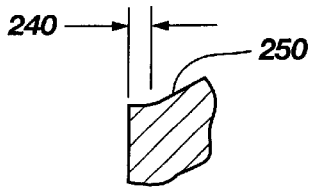
FIG. 3D is an enlarged cross-sectional detail of area D in FIG. 3A.

FIG. 3A shows yet another substrate end face configuration for a cutter according to the present invention in cross-section, while FIG. 3B shows substrate 212 in side elevation and FIG. 3C is a top elevation of end face 214. As with the other embodiments, substrate 212 is substantially cylindrical and includes a number of contiguous annular surfaces surrounding a circular central surface on end face 214. From the side exterior of substrate 212 inwardly, an annular lip or shoulder 240 extends inwardly from sidewall 234, meeting annular surface 242, which comprises a spherical surface of revolution. Annular arcuate surface 244 lies inwardly of surface 242, within which lies arcuate surface 246, within which lies a central surface of revolution 248. Surfaces 242, 244 and 246 are substantially coincident at their mutual boundaries, while the transition between lip 240 and surface 242 comprises a small but measurable radius 250 (see enlarged detail in FIG. 3D). Similarly, the transition between surface 246 and central surface 248 comprises a small but measurable radius 252.

Figure 4:
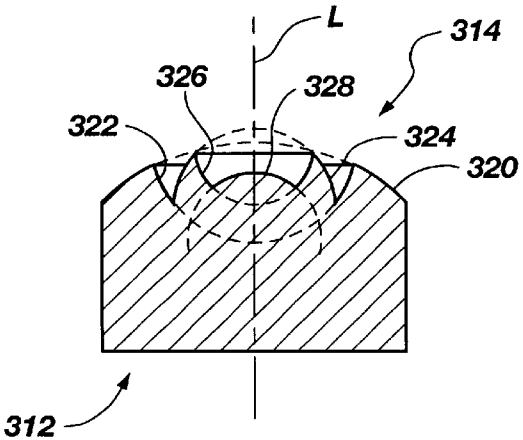

FIGS. 4 though 16 illustrate a number of other substrate end face configurations according to the invention, it being understood that superabrasive tables such as PDC tables when formed thereon, will provide cutters according to the invention.

Figure 5:
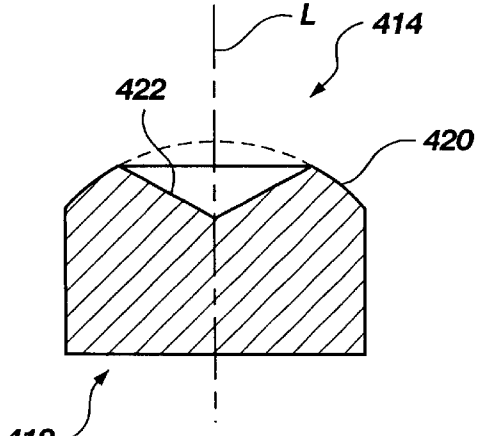

FIG. 4 depicts a side sectional elevation of a substantially cylindrical substrate 312 having an end face 314 comprising a plurality of mutually adjacent spherical surfaces of revolution 320, 322, 324, 326 and 328, the center points of which all lie coincident with the centerline or longitudinal axis L of the substrate 312. In this and subsequent figures, extensions of the actual end face spherical surfaces of revolution in the plane of the paper have been shown in broken lines for a better appreciation of the spherical nature thereof FIG. 5 depicts a side sectional elevation of a substantially cylindrical substrate 412 having an end face 414 comprising a single outer spherical annular surface of revolution 420 surrounding an upward-facing conical surface of revolution 422, the center points of both surfaces of revolution lying on the centerline or longitudinal axis L of the substrate 412.

Figure 6:
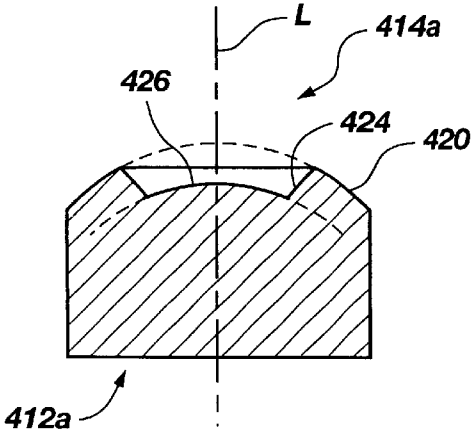
FIGS. 4 through 16 depict, in side sectional elevation, additional embodiments of substrates having utility with superabrasive cutters according to the present invention.

FIG. 6 depicts a side sectional elevation of a substantially cylindrical substrate 412*a* having an end face 414*a* comprising a single outer spherical annular surface of revolution 420 surrounding an upward-facing frustoconical surface of revolution 424, which in turn surrounds a convex spherical surface of revolution 426. All three surfaces of revolution have center points coincident with the centerline or longitudinal axis L of substrate 412*a*.

Figure 7:
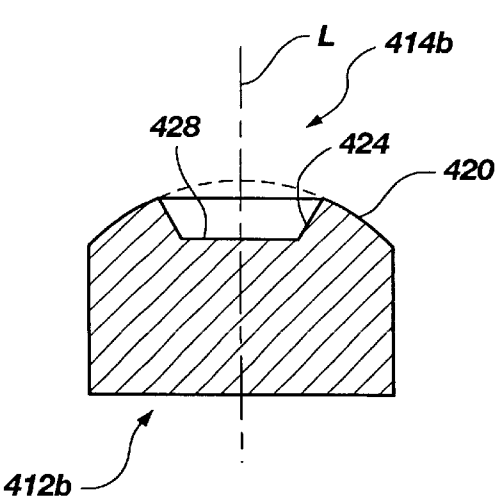

FIG. 7 depicts a side sectional elevation of a substantially cylindrical substrate 412*b* having an end face 414*b* comprising a single outer spherical annular surface of revolution 420 surrounding an upward-facing frustoconical surface of revolution 424, which in turn surrounds a central circular surface 428. Both surfaces of revolution have center points coincident with the centerline or longitudinal axis L of substrate 412*b*.

Figure 8:
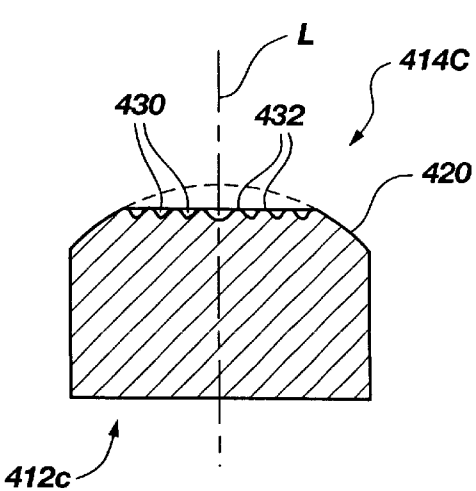

FIG. 8 depicts a side sectional elevation of a substantially cylindrical substrate 412*c* having an end face 414*c* comprising a single outer spherical annular surface of revolution 420 surrounding a plurality of concentric annular grooves 430 having ridges 432 therebetween, the end face features being centered about centerline or longitudinal axis L.

Figure 9:
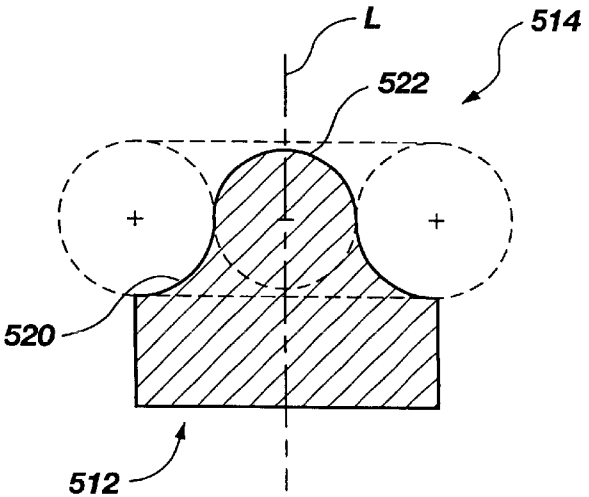

FIG. 9 depicts a side sectional elevation of a substantially cylindrical substrate 512 having an end face 514 comprising a central hemispherical surface 522 contiguous with and surrounded by a concave annular surface 520 comprised of a portion of a toroid of circular cross-section centered about the centerline or longitudinal axis L of substrate 512.

Figure 10:
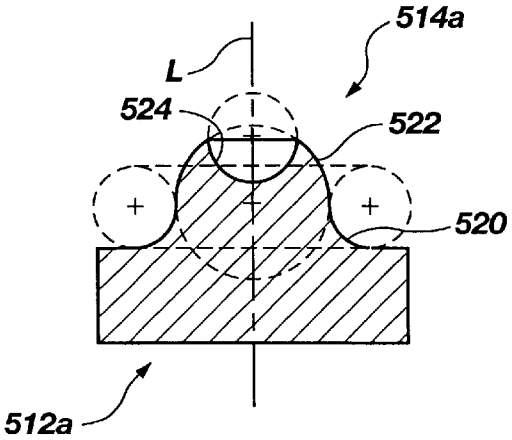
Figure 11:
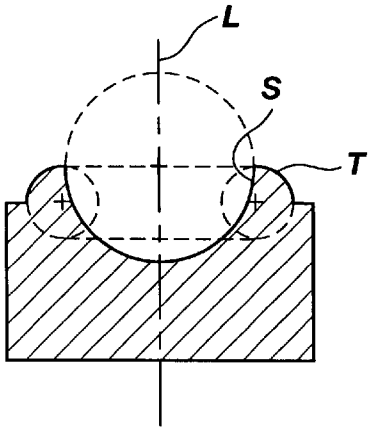
Figure 12:
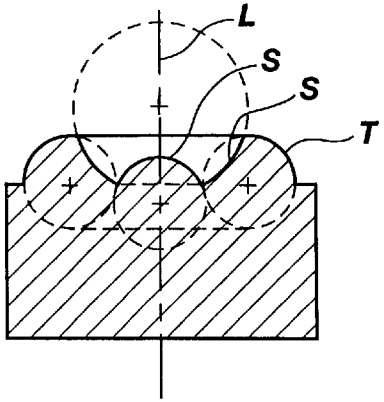
Figure 13:
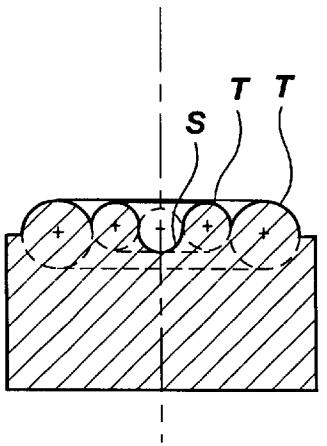
Figure 14:
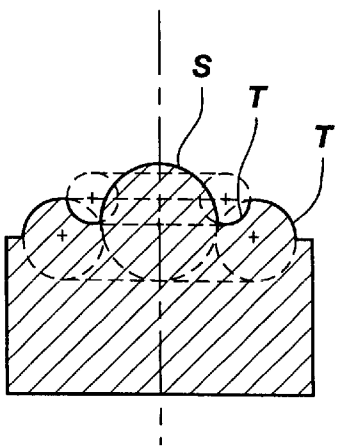
Figure 15:
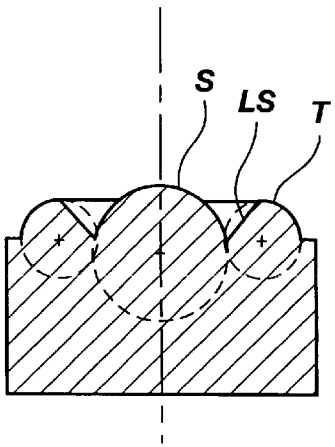

FIG. 10 depicts a side sectional elevation of a substantially cylindrical substrate 512*a* similar to substrate 512, having an end face 514*a* comprising a central hemispherical surface 522 contiguous with and surrounded by an annular surface 520 comprised of a portion of a toroid of circular cross-section. Hemispherical surface 522, however, is intersected by a smaller spherical surface of revolution 524 defining a central recess or concavity therein.

Other combinations of substrates exhibiting end faces comprised of various combinations of spherical, toroidal and linear surfaces of revolution are depicted in FIGS. 11 through 15. As with the preceding FIGS. 4 through 10, spherical surfaces of revolution and toroids, parts of which comprise substrate surfaces, have been shown in part in most instances in broken lines for clarity, as have center points of certain features.

Spherical surfaces of revolution have been designated with an "S", toroids with a "T", and linear surfaces of revolution with an "LS".

Figure 16:
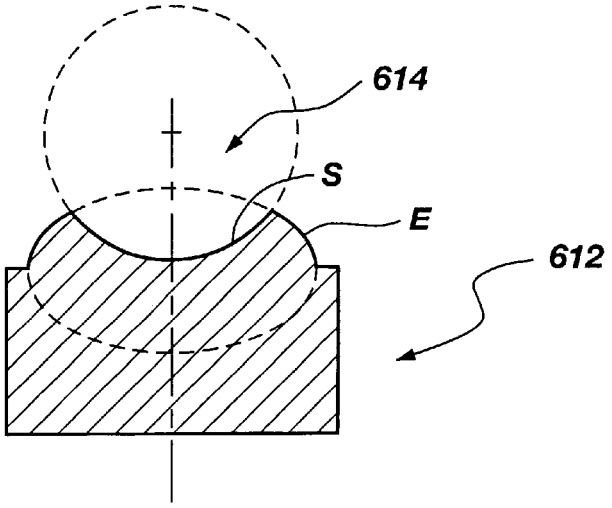

It will also be understood that spherical surfaces of revolution may be replaced, as noted above, by spheroidal surfaces of revolution, as depicted in FIG. 16 showing a substrate 612 having ellipsoidal surface of revolution E on its end face 614. Other non-linear, or arcuate, surfaces of revolution may also be employed, as desired, in a similar or transverse orientation to that shown in FIG. 16.

Figure 17:
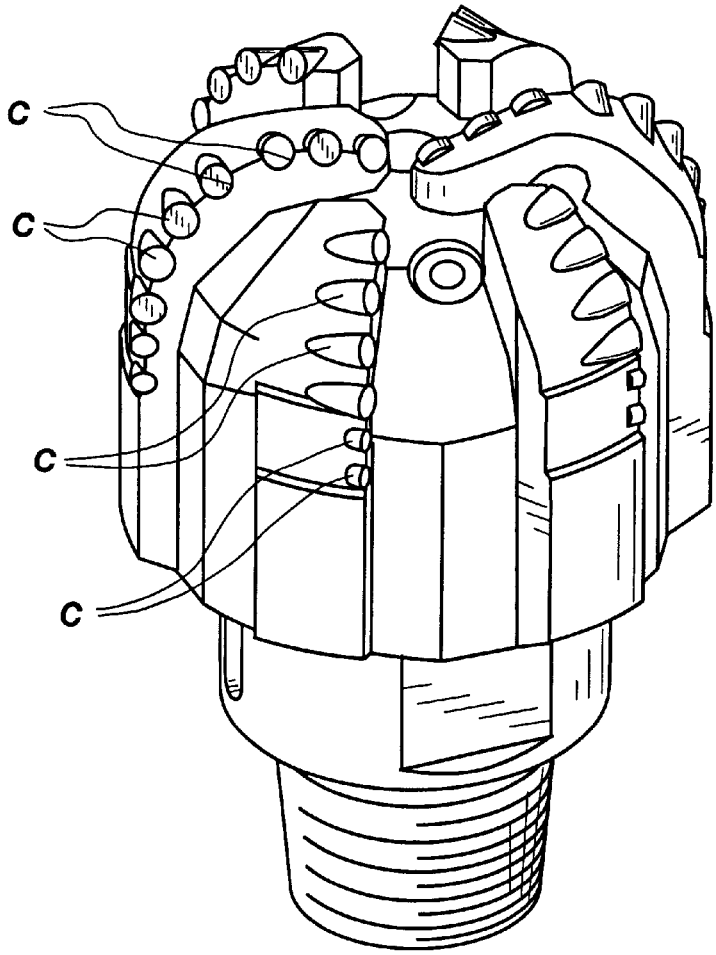
FIG. 17 is a side perspective view of a rotary drag bit equipped with cutters according to the present invention.
Figure 18:
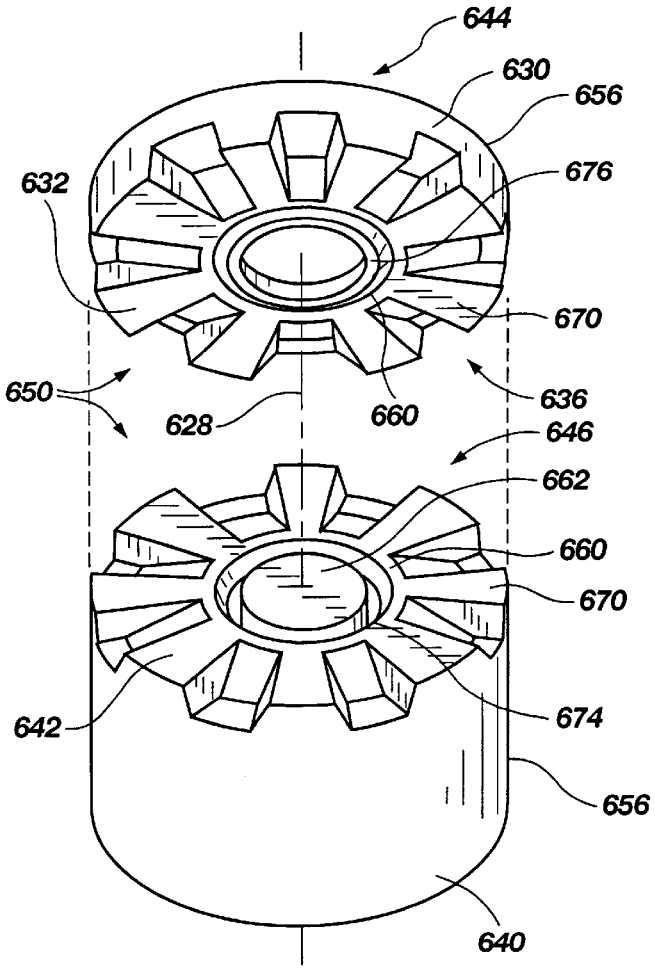
FIG. 18 is an isometric exploded view of another drill bit cutter of the invention.
Figure 20:
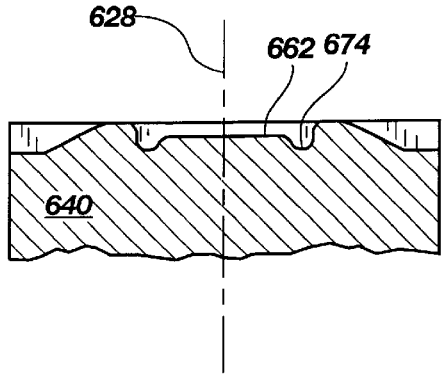
FIG. 20 is a cross-sectional side view of a substrate of another drill bit cutter of the invention, as taken along line 20—20 of FIG. 19.
Figure 21:
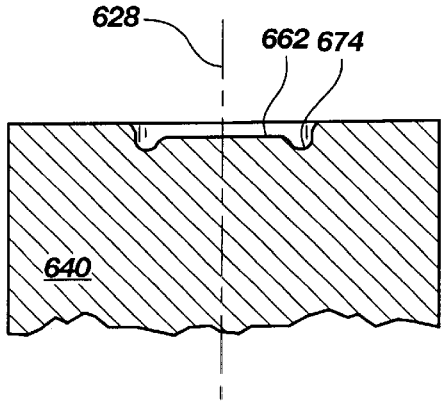
FIG. 21 is a cross-sectional side view of a substrate of another drill bit cutter of the invention, as taken along line 21—21 of FIG. 19.
Figure 19:
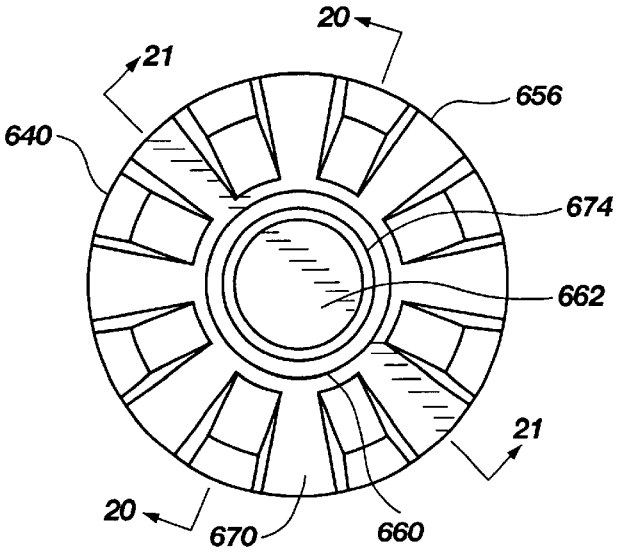
FIG. 19 is a plan view of an interfacial area on a substrate of another drill bit cutter of the invention.

FIG. 17 depicts a rotary drag bit equipped with cutters C in accordance with the present invention.

In FIGS. 18–21, another embodiment of the invention is shown with a gear-configured interface 650 of intermeshing diamond table pattern 636 and substrate pattern 646. Each of diamond table 630 and substrate 640, which are aligned along longitudinal axis 628, has a series of radially projecting members 670 which intersect the outer cutter periphery 656 and an inner circular member 660. The substrate is shown with an annular depression 674 within the inner portion of circular member 660 surrounding central protrusion 662. Diamond table 630 has a complementary annular projecting member 676 which fits into and is received by depression 674. The particular pattern may be varied in many ways, provided a series of radial members 670 intersect with at least one circular or polygonal member 660. For example, projecting radial members 670 of substrate 640 may be of the same or differing shape, width, and depth than the projecting radial members 670 of the diamond table 630.

For ease of illustration, the drawings generally show the interfacial surfaces 632, 642 as having sharp corners. It is understood, however, that in practice, it is generally desirable to have rounded or beveled corners at the intersections of planar surfaces, particularly in areas where cracking may propagate. Furthermore, the various circular and polygonal annular members shown in the FIGS. are illustrative, and annular members 660 may also have geometries incorporating arcuate or curved segments combined with straight segments in an alternating fashion, for example, to produce an irregularly shaped generally annular member, if desired.

The substrate 640 and/or diamond table 630 may be of any cross-sectional configuration or shape, including circular, polygonal and irregular. In addition, the diamond table may have a cutting face 644 which is flat, rounded, or of any other suitable configuration.

Figure 22A:
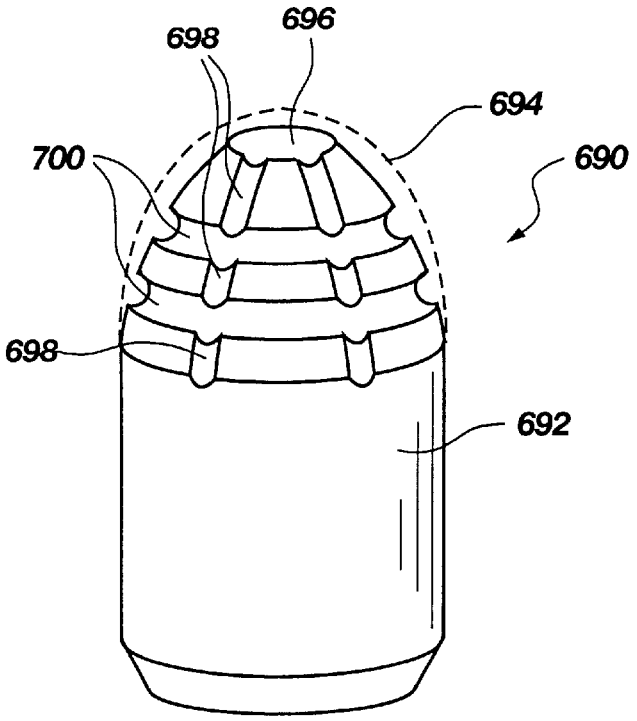
FIG. 22A is a front view of another drill bit cutter embodying the present invention.
Figure 22B:
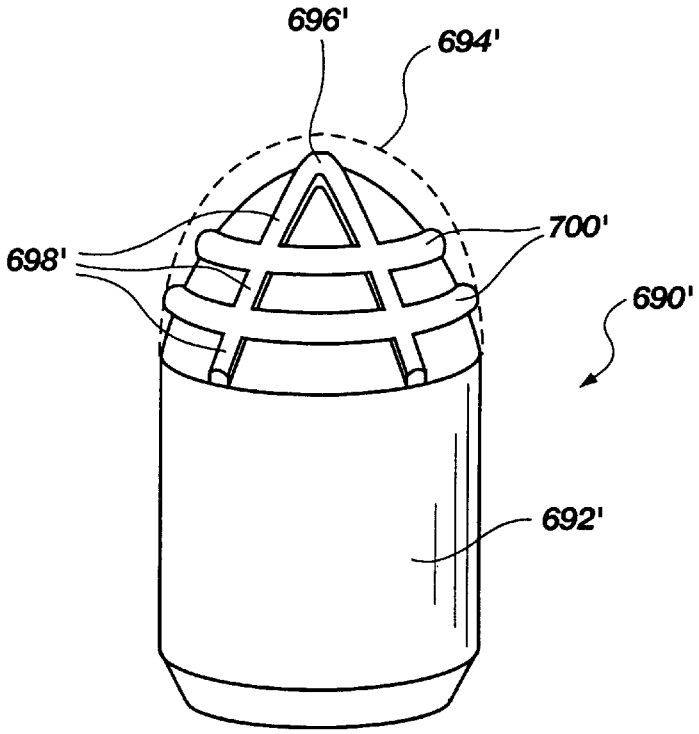
FIG. 22B is a front view of yet another drill bit cutter embodying the present invention.

FIG. 22A depicts another embodiment of the present invention wherein a cutter 690 is particularly suitable for, but not limited to, use as a rolling cone insert in a roller cone or rock drill bit. Cutter 690 has a carbide, preferably tungsten carbide, substrate 692 and has a superabrasive or diamond table or compact 694 shown in phantom placed upon substrate 692 in the manner known and discussed above. The contoured interface between diamond compact 694 and substrate 692 is provided with generally radially oriented grooves 698 preferably extending from preferably planar center 696 toward the outer circumference of cutter 690. Generally annular or concentric recessed grooves 700 extending circumferentially preferably intersect and segment radial grooves 698 into a plurality of interrupted, generally radially oriented grooves, or recessed portions, to provide the desired compressive pre-stress within diamond compact 694 and in the vicinity of the interface. More particularly, the interior portion of diamond table or compact 694 is preferably placed in radial compression and the exterior portion of the diamond table or compact 694 is placed in circumferential compression with the net result of generally bi-axial compressive pre-stresses being distributed throughout the diamond table or compact 694 and the interface between substrate 692 to better withstand the various types of primarily tensile forces acting on the cutter when placed in service. Furthermore, radially oriented grooves 698 and/or annular grooves 700 may alternatively be configured to be ribs protruding from substrate 692 and received within compact 694 with such a configuration being shown in FIG. 22B. As shown in FIG. 22B, cutter 690' can be constructed with the same materials and processes as described with respect to cutter 690 but instead has a substrate 692' also having a diamond table or compact 694' shown in phantom placed upon substrate 692' as known in the art.

However, the contoured interface between diamond compact 694' and substrate 692' is provided with generally radially oriented raised ribs or ridges 698' preferably extending from preferably raised center 696' toward the outer circumference of cutter 690'. Generally annular or concentric raised portions, referred to as ribs or ridges 700' extending circumferentially preferably intersect and join with radial ridges 698' to achieve the same results as described with respect to cutter 690 of FIG. 22A. In a like manner, diamond compact 694' would have an interface accommodating the raised ridges of substrate 692' but in a reverse pattern as described earlier. When constructing a cutter in accordance with alternative cutter 690', care must be exercised not to allow the ribs or raised portions to protrude too far into compact 694' so as to prevent the relatively thin or reduced thickness of compact 694' where such raised portions are placed from being vulnerable to localized chipping or breakage.

As can now be appreciated, a cutter interface embodying the present invention provides a cutter which has greater resistance to fracture, spalling, and delamination of the diamond table or compact.

Figure 23:
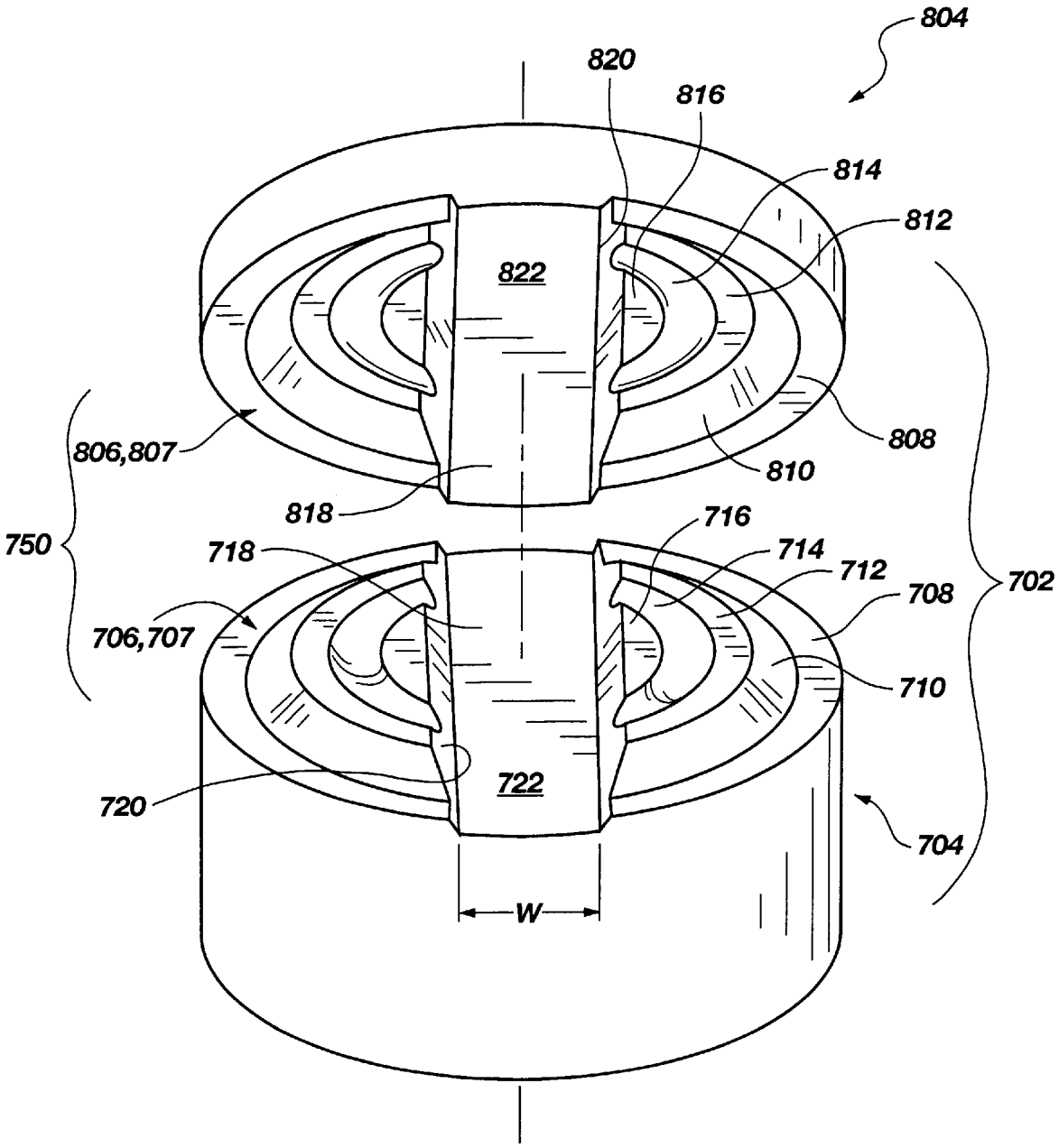
FIG. 23 is an isometric exploded view of yet another drill bit cutter embodying the present invention.

FIG. 23 provides an exploded illustration of yet another cutter 702 embodying the present invention. Cutter 702 includes a substrate 704 having a superabrasive diamond compact table 804 removed from interface 750, which includes substrate interface surface 706 having a pattern 707 and diamond table interface surface 806 having a mutually complementary but reverse pattern 807. Substrate interface pattern 707 includes circumferential rim, shoulder, or ledge portion 708 and inwardly sloping circumferential wall 710 leading to a first raised portion 712. Raised portion 712 preferably has a generally planar surface, but is not limited to such. Inward of raised portion 712 is a concentric or annular groove 714 and inward of groove 714 is a second raised portion 716. As can be seen in FIG. 23, a full-diameter, generally rectangularly shaped slot 718 extending to a preselected depth divides interface pattern 707 into symmetrical halves with recessed region, groove, or slot 718, having walls 720 set apart by a width W. Slot 718 is preferably provided with a generally planar bottom surface 722.

In a reverse fashion, the interfacial pattern 807 of diamond table 804 is provided with a peripheral rim 808 which co-joins with rim 708 and sloping wall 810 co-joins with sloping wall 710. First recessed portion 812 separated by protruding concentric ridge 814 and second recessed portion 816, respectively, accommodate raised portions 712 and 716 and groove 714 of substrate 704. Also extending across the full diameter pattern 807 of interface surface 806 of diamond table 804, is a generally rectangular tang or tab 818 to correspond and fill rectangular slot 718. Tang walls 820 likewise co-join with slot walls 720 and tang surface 822 co-joins with bottom surface 722 of slot 718. Tang 818 in combination with slot 718, in effect, provides the previously described interfacial stress optimization benefits of the radially extending grooves and complementary raised portions of the cutters illustrated in the previous drawings.

Preferably, width W of slot 718/tang 818 ranges from approximately 0.04 to 0.4 times the diameter of cutter 702. However, width W of slot 718/tang 818 may be of any suitable dimension. Preferably, the depth of slot 718/tang 818 does not exceed the approximate thickness of superabrasive table 804 extending over the substrate regions other than those directly above slot 718/tang 818. In other words, the approximate depth of slot 718/tang 818 preferably does not exceed the approximate minimum thickness of superabrasive table 804. However, slot 718/tang 818 can have any depth deemed suitable. Although slot 718 and tang 818 have been shown to have the preferred generally rectangular cross-sectional geometry, including generally planar walls 720, 820 and surfaces 722, 822, slot 718/tang 818 can be provided with other cross-sectional geometry if desired. For example, walls 720 can be generally planar but can be provided with radiused corners proximate bottom surface 722 to form a more rounded cross-section. Walls 720 and bottom surface 722 can further be provided with nonplanar configurations, if desired, so as to be generally curved or irregularly shaped.

Correspondingly, tang 818 can be provided with radiused curvatures where walls 820 join or intersect surface 822 to provide a tang of a generally more curved cross- section than the preferred generally rectangular cross-section as shown. Walls 820 and surface 822 can further be provided with nonplanar configurations to correspond and complement nonplanar configurations chosen for walls 720 and bottom surface 722 of slot 718.

Although cutter 702 is shown with the interfacial end of substrate 704 being generally planar or flat across raised portions 716, 712 and rim 708, the general overall configuration of interfacial surface 706 can be dome or hemispherically shaped, such as the interfacial ends of substrates 692 and 692' of cutters 690 and 690', respectively, illustrated in FIGS. 22A and 22B, yet maintain the preferred interfacial pattern shown in FIG. 23 or variations thereof Similarly, superabrasive table 804 would be reversely configured and shaped to form a generally dome shaped table, such as tables 694 and 694', and would be disposed over and having a complementary interfacial surface 806 to accommodate such a modified interfacial surface 706. A modified cutter having such a hemispherical-shaped substrate and superabrasive table is particularly suitable for installation and use on roller cone style drill bits in which a plurality of cutters are installed on one or more roller cones so as to be moveable with respect to the drill bit while engaging the formation.

Thus, it can be appreciated that a single large radially or diametrically extending protrusion and complementary configured recessed portion may also be used to achieve the benefits of the present invention.

As with cutters 690 and 690' illustrated in FIGS. 22A and 22B, respectively, cutter 702 can have patterns 707 and 807 reversed. That is a tang protruding upward from substrate interface surface 706 being disposed into a receiving slot in diamond table interface surface 806. Similarly, raised portions 712 and 716 could instead be recessed portions to accommodate complementary raised portions extending from table 804.

FIGS. 24A–24F show a cutter substrate 850 constructed of a suitable material, such as tungsten carbide, which includes a generally circular-shaped end face 852 comprising a preselected topographic configuration in accordance with the present invention. Substrate 850 includes a radially outermost sidewall 854 generally defining the radially outermost periphery of substrate 850 and another end face 872, which may include a peripheral chamber, as illustrated. End face 852 includes a first annular arcuate surface 856 exhibiting a convex shape being defined by a spherical surface of revolution having a center point coincident to longitudinal centerline or axis L. Generally surrounding and abutting the outermost periphery of convex surface 856 is a second annular arcuate surface 858 exhibiting a concave shape being defined by a partial surface of a first toroid having a center point radially offset from the longitudinal centerline L. Generally surrounding and abutting the outer periphery of concave surface 858 is a third annular arcuate surface 860 exhibiting a convex shape being defined by a partial surface of a second toroid having a center point radially offset from the longitudinal centerline L. Extending from the radially outermost portion or periphery of concave surface 858 is a radially inset sidewall 862 which extends generally parallel to the longitudinal centerline L so as to intersect or join annular ledge surface 864. Annular ledge surface 864 may also be referred to as a shoulder or circumferential rim. Annular ledge surface 864 preferably extends radially outward from radially inset sidewall 862 to intersect or join radially outermost sidewall 854. Preferably, annular ledge surface 864 is generally perpendicular to longitudinal centerline L and, thus, is also generally perpendicular to radially outermost sidewall 854, although it should be understood that sidewall 854 may include a small draft angle in order to facilitate the removal of substrate 850 from its forming mold (not shown) as is known in the art.

Extending generally transversely across a substantial portion of end face 852 is a recessed region 866 which may also be referred to as a slot or groove. Recessed region 866 includes a preferably generally planar bottom surface 868 and a pair of opposing side walls 870. Opposing side walls 870 are preferably sloped or angled, as can be more easily seen in FIG. 24C, so as to be separated by a distance $W_{1L}$ referred to as the longitudinally lower width of recessed region or groove 866. Upper width of recessed region $W_{1U}$ is preferably slightly larger than $W_{1L}$ so as to provide a slope with respect to the longitudinal centerline that side walls 870 preferably have. Also shown in FIG. 24C is the outer diameter d of radially inset side wall 862, which can be referred to as the "post" diameter of substrate 850. That is, the portion of end face 852 which extends longitudinally above annular ledge surface 864 can be referred to as a "post" in which superabrasive table 880 will be disposed on and about. Diameter d also corresponds with the preferred diametrical length of recessed region 866.

Figure 24A:
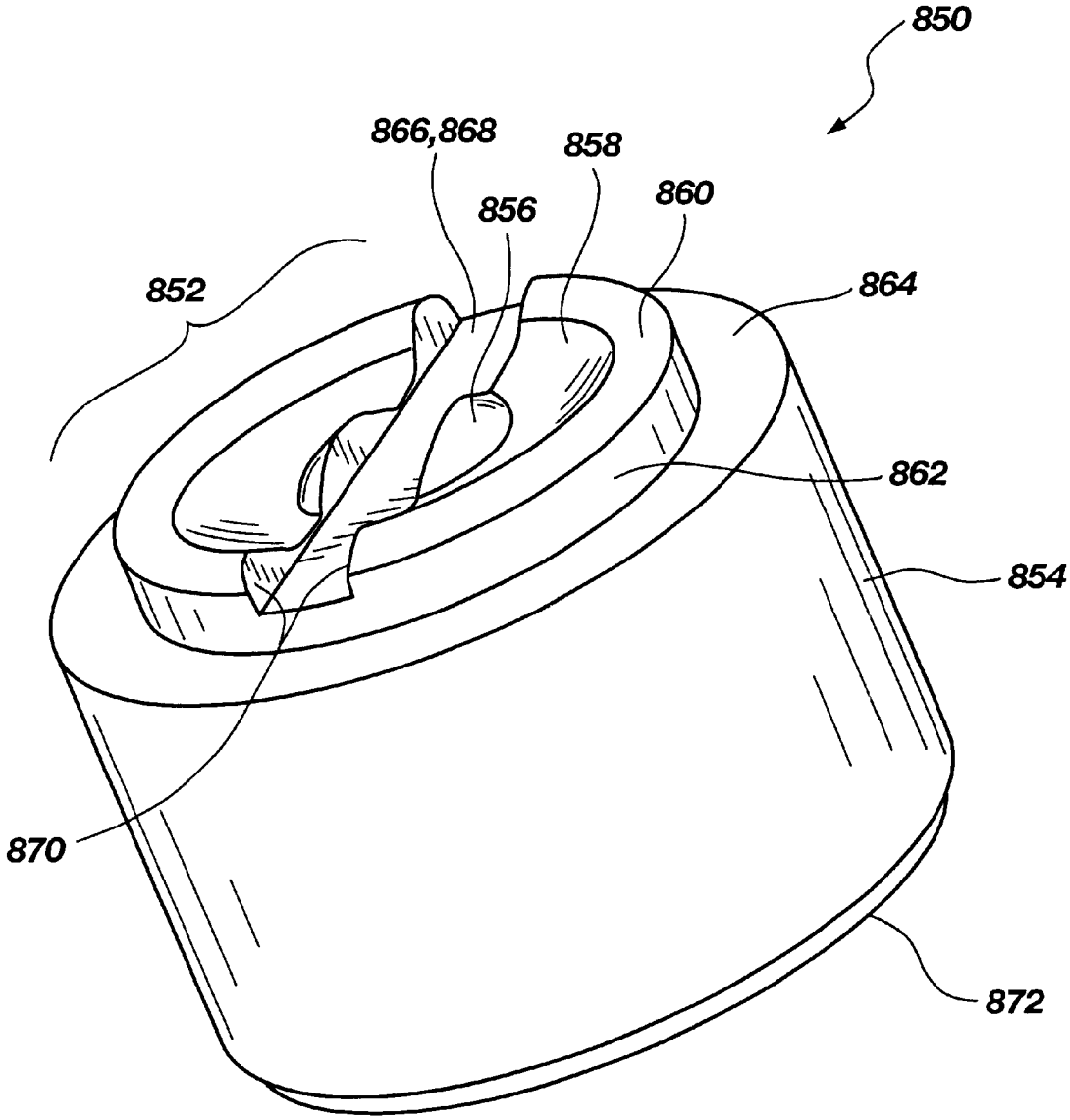
FIG. 24A is a perspective view of an exemplary cutter substrate including a single groove in the substrate end face.
Figure 24B:
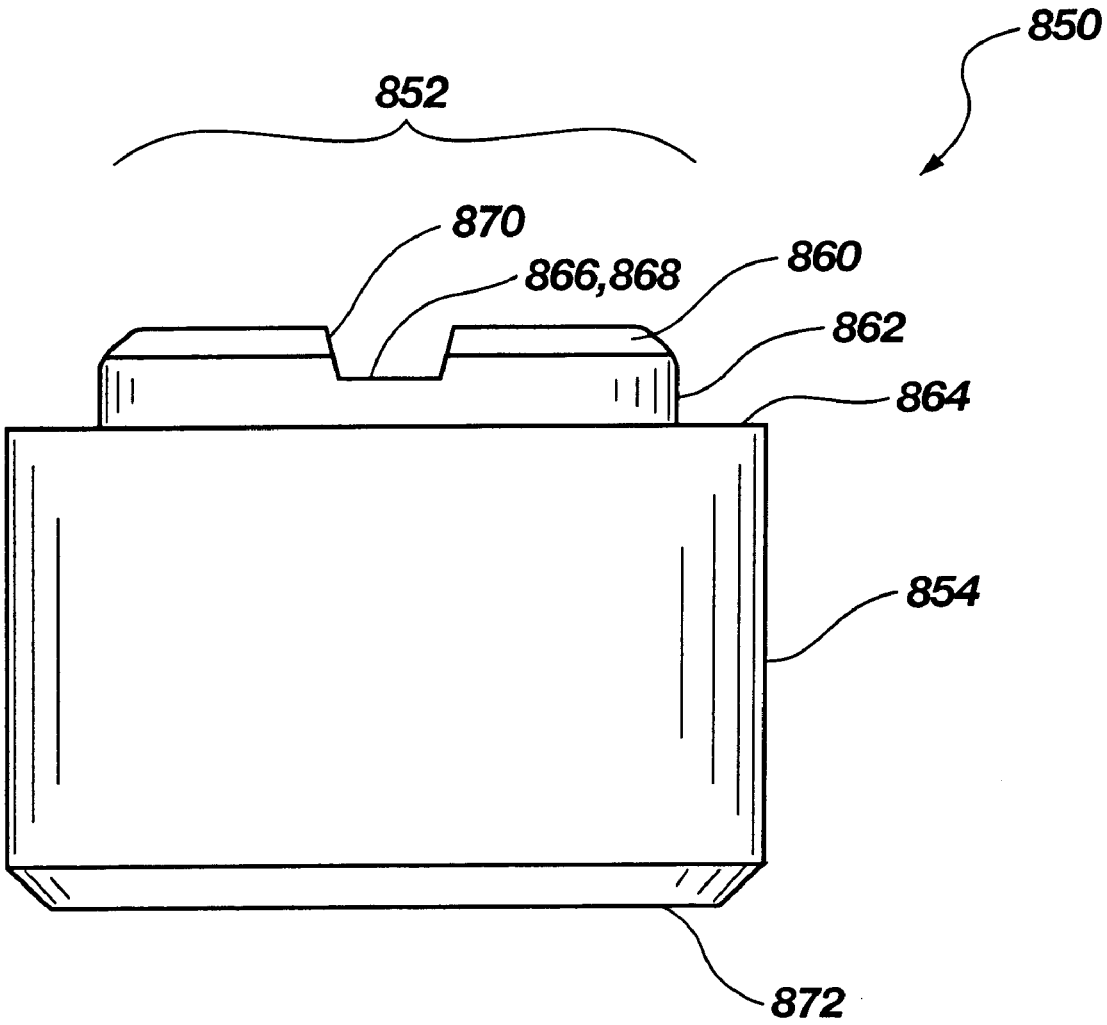
FIG. 24B is a side view of the cutter substrate of FIG. 24A.
Figure 24D:
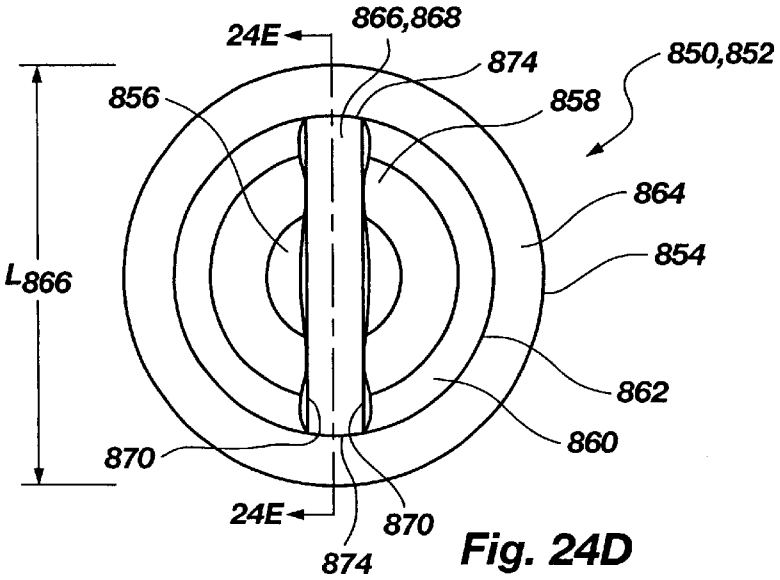
FIG. 24D is a top view of the end face of the cutter substrate of FIG. 24A.
Figure 24C:
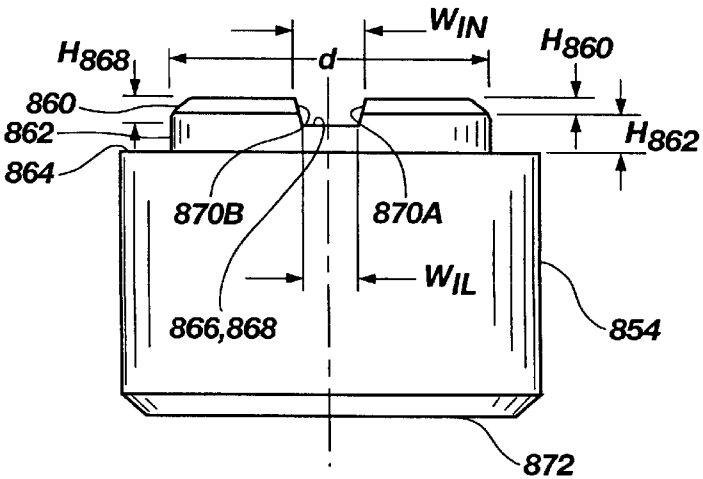
FIG. 24C is an additional side view of the cutter substrate of FIG. 24A.

As can be seen in FIGS. 24C and 24D, recessed region 866 comprises opposite ends 874 which define the radial extent of recessed region 866. That is, each end 874 is positioned radially proximate to radially inset side wall 862, thereby resulting in recessed region 866 stopping radially short of annular ledge surface 864. Generally planar bottom surface 868 is preferably longitudinally positioned above annular ledge surface 864 and positioned below the longitudinally uppermost extent of convex surface 860 which can be referred to as height $H_{868}$ as shown in FIG. 24C. Also shown in FIG. 24C are respective heights, as taken in radial cross-section longitudinally parallel to the longitudinal centerline, of convex surface 860 and radially inset side wall 862 designated as $H_{860}$ and $H_{862}$, respectively. Preferably, recessed regions, grooves, or slots 866 are ground into end face 852 of substrate 850 after substrate 850 has been formed by high-pressure, high-temperature forming processes known in the art so as to enhance the bond strength of a subsequently disposed volume of superabrasive material on end face 852 to provide a superabrasive table thereon. Alternatively, recessed regions 866 may be molded into end face 852 of substrate 850 when substrate 850 is initially constructed and may then be bead or sand blasted or otherwise prepped for receiving a volume of superabrasive material disposed thereover.

Figure 24E:
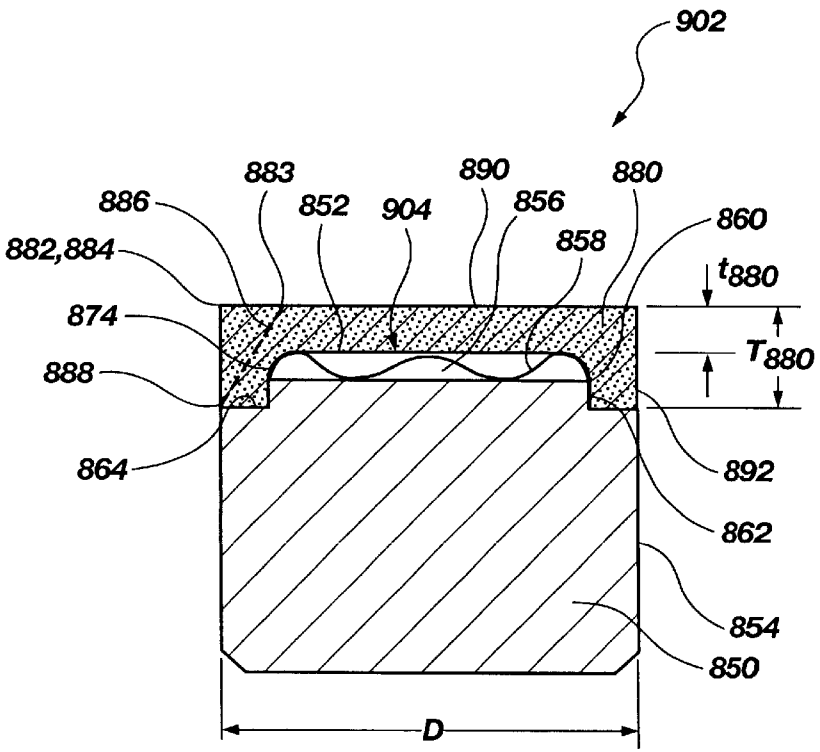
FIG. 24E is a cross-sectional view of the cutter substrate as shown in FIG. 24D having a superabrasive table disposed thereon which includes a wear flat.

FIG. 24E depicts a cross-sectional view of substrate 850 after a superabrasive diamond table 880 comprised of a volume of superabrasive material known within the art has been disposed onto end face 852 by high-temperature, high-pressure methods known in the art. Superabrasive table 880 includes a top surface 890, a side surface 892, which is generally the same diameter D as is substrate 850, and further includes an interface 904 where superabrasive table 880 is co-joined to end face 852. Superabrasive table 880 further includes a side wall 862 having a radially outermost extent 888 proximate to both side wall 854 and initial peripheral or cutting edge 882. Peripheral edge 882 typically will move radially inward to position 883 or beyond, as a wear-flat or surface 886, shown in phantom, forms upon cutter 902. Such a wear-flat is expected to form upon cutter 902 actually being used to engage a formation after cutter 902 has been installed on the face or blade structure of a drill bit, such as the drill bit illustrated in FIG. 17. Superabrasive table 880 exhibits a preselected maximum thickness $T_{880}$, as usually measured from annular ledge surface 864 to top surface 890 of table 880, which ranges upward of 0.250 of an inch. Superabrasive table 880 will generally exhibit a preselected minimum thickness $t_{880}$ when manufactured and is usually measured from the topmost portion of end face 852 to top surface 890 of table 880. Although there is generally no required minimum table thickness $t_{888}$, a newly formed and unused dimension for $t_{880}$ preferably ranges from 0.030 to 0.090 of an inch so as to provide a cutter with a superabrasive table of sufficient thickness for a suitable useful life. Cross-sectional view FIG. 24E also illustrates the preferred orientation of recessed region 866 with respect to the location in which wear flat 886 is expected to form when cutter 902 is placed in operation. That is, it is preferred that wear flat 886 form radially proximate one of the end regions or portions 874 of recessed regions or groove 866 for reasons to be discussed hereinbelow.

Figure 24F:
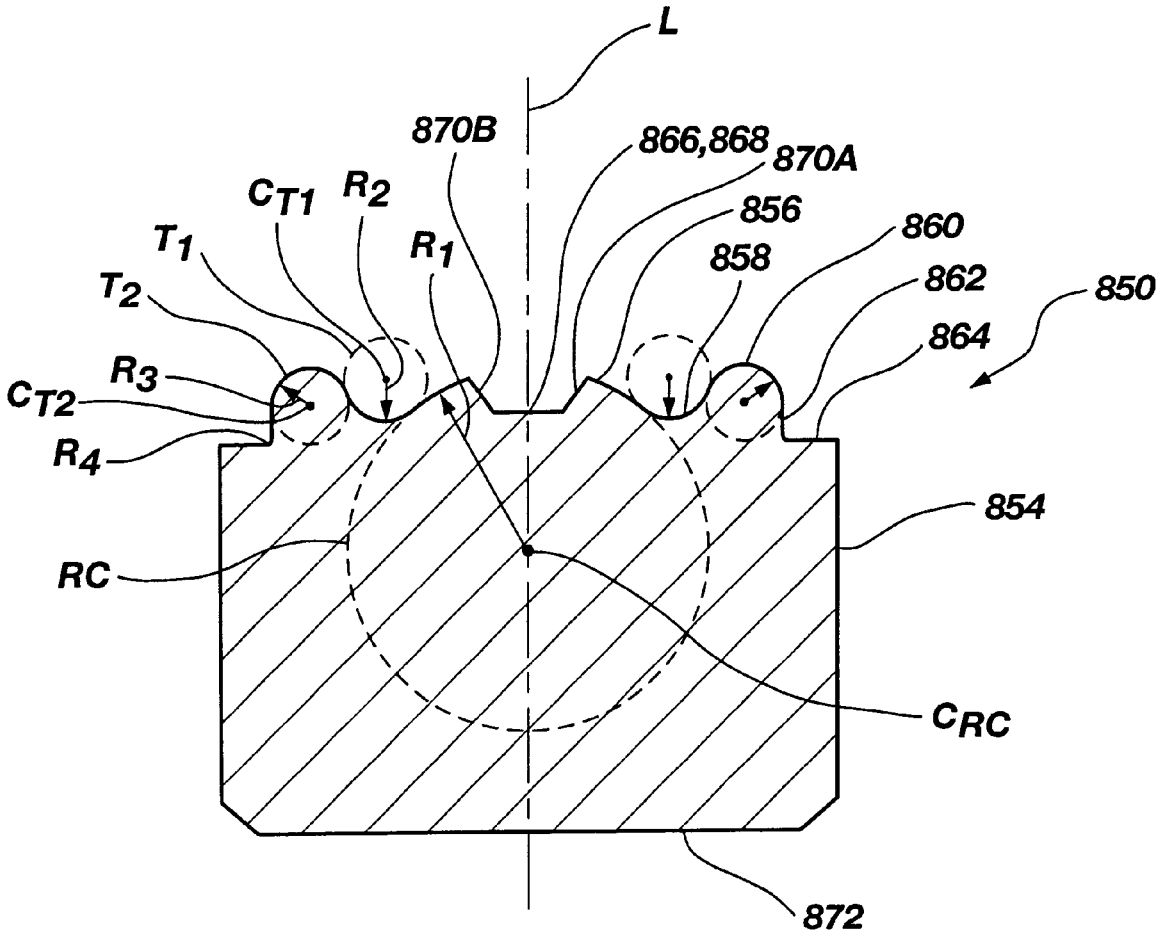
FIG. 24F is a cross-sectional schematic view of the cutter substrate of FIG. 24A.

FIG. 24F is a full-diameter, radial cross-sectional view taken parallel to longitudinal centerline L and showing the end face 852 of substrate 850. As shown, spherical surface of revolution RC defining convex surface 856 includes a design or reference radius $R_1$, extending outwardly from centerpoint $C_{RC}$ which is positioned coincident to longitudinal centerline L. Concave surface 858, which surrounds and adjoins the outer periphery of convex surface 856, is defined by a partial surface of toroid $T_1$ having a radius $R_2$ and a centerpoint $C_{T1}$. Convex surface 860, which surrounds and adjoins the outer periphery of concave surface 858, is defined by a partial surface of toroid $T_2$ having a radius $R_3$ and a centerpoint $C_{T2}$. Radially inset side wall 862 extends generally vertically downwardly from the radially outer extent of convex surface 860 so as to intersect or meet annular ledge surface 864. Preferably, the junction between radially inset side wall 862 and annular ledge surface 864 includes a radius of curvature $R_4$ so as to prevent stress risers from occurring. Radially inset side wall 862 need not be parallel to longitudinal centerline L, but can be angled with respect thereto, or be provided with multiple annular surfaces as will be illustrated with respect to other embodiments of the present invention.

A number of cutters having a substrate/superabrasive table interface configured as illustrated with respect to cutter 902 were constructed and successfully lab tested by the Assignee of the present invention. The following exemplary dimensions of the tested cutters are set forth below:

D=0.75 inches(19 mm)

d=0.570 inches $W_{1L}$=0.1 inches, $W_{1U}$=0.13 inches $R_1$=0.148 inches, $R_2$=0.13 inches, $R_3$=0.87 inches, $R_4$=0.015 inches $H_{860}$=0.034 inches, $H_{862}$=0.066 inches, $H_{868}$=0.05 inches T=0.16 inches t=0.07 inches It should be understood that the above dimensions of the exemplary test cutters constructed by the Assignee hereof are merely exemplary and cutters incorporating the present invention can be constructed to have an end face configuration having a wide variety of geometries and specific dimensions. Furthermore, the specific dimensions of various specific geometric configurations included in the above example of a cutter embodying the present invention may be resized and reconfigured so as to optimize the benefits offered by the present invention for particular formations and drill bit applications.

Laboratory testing of the above exemplary cutters having the configuration of cutter 902, including recessed region 866 and the dimensions set forth above, included engaging a sierra white granite formation with the test specimens and measuring the amount of formation cut by the cutter prior to the superabrasive table failing or being retired due to the amount of wear to the table. The test results indicated that such cutters having recessed region 866 were 26 percent more durable than test cutters having the same end surface configuration and dimensions of the test examples of cutter 902 absent recessed region 866. In other words, test cutters having recessed region 866 proved to be 26 percent more durable than cutters having generally the same end face configuration with the exception of not having a diametrically extending recessed region 866 being filled with superabrasive material.

Upon conducting finite element analysis on the cutters having the configuration of exemplary cutter 902, it appears that including a recessed region or groove, such as recessed region 866, serves to mitigate or inhibit the subsequent propagation of any cracks in the superabrasive table, such as table 880, that may develop upon the cutter being placed in service. Thus, the recessed region, or conversely, the "bar" or "tang" region of the superabrasive table which protrudes into and fills the recessed region, appears to be instrumental in extending the durability of cutters incorporating the present invention.

Another embodiment of the present invention is depicted in FIGS. 25A–25D. Alternative substrate 850' having an alternative end face 852' is provided with a second recessed region 866B in addition to a first recessed region 866A. Generally speaking, end face 852' of alternative substrate 850' is constructed to have generally the same topographic configuration as end face 852 of substrate 850 as previously illustrated and discussed with the exception of being provided with at least one additional recessed portion. Substrate 850' also includes a sidewall 854 and another end face 872. As can be seen in the respective views provided by FIGS. 25B–25D, second recessed region 866B is preferably provided with the same features and same dimensions as first recessed region 866A. That is, second recessed region includes side walls 870B extending generally longitudinally downwardly to meet bottom surface 868B which extends diametrically across end face 852' proximate to, but preferably radially short of, annular ledge surface 864 so as, in effect, to have a length equal to dimension d. That is, end portions 874B are preferably positioned proximate radially inset wall 862 and, thus, do not extend radially therebeyond.

Figure 25A:
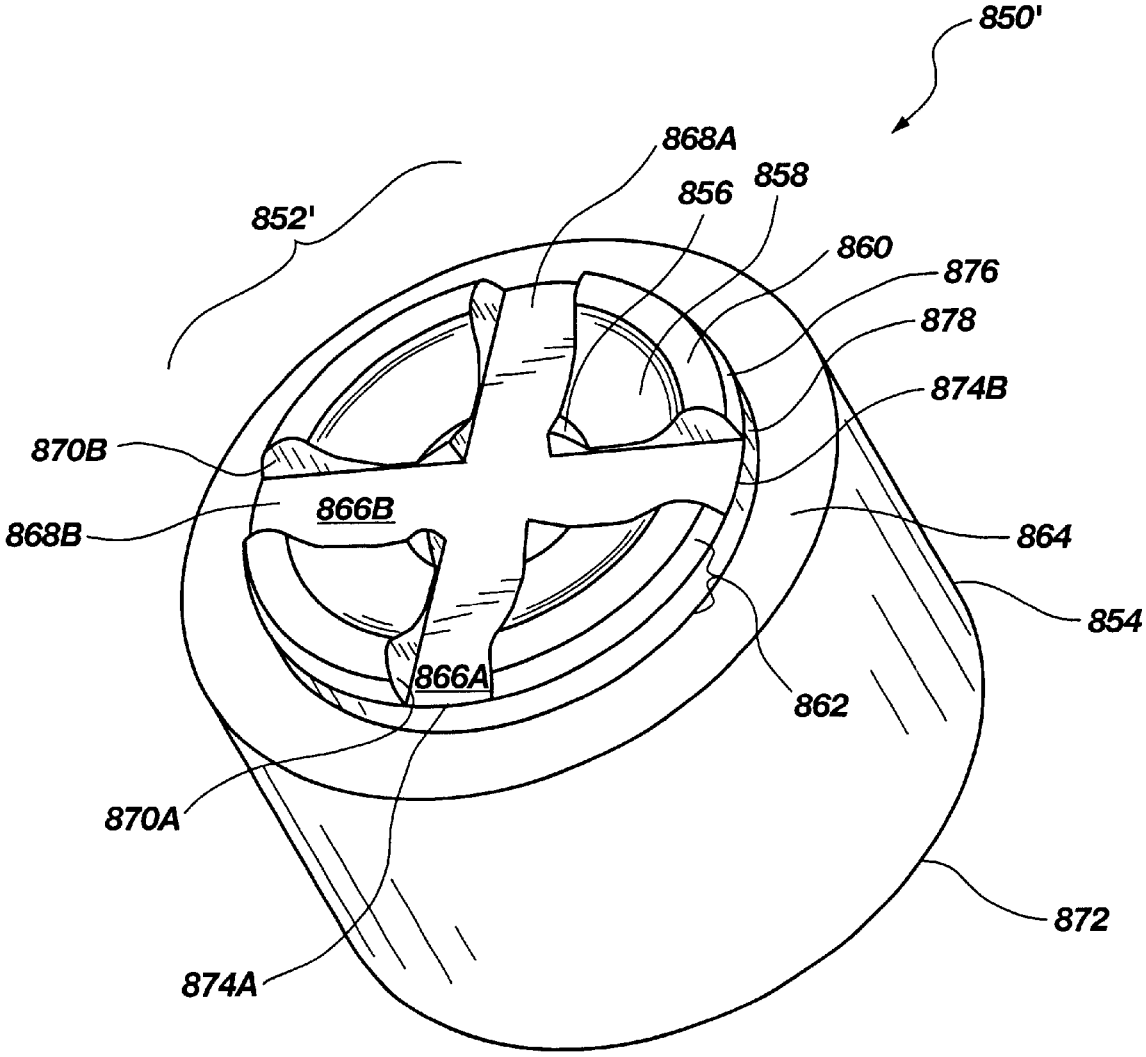
FIG. 25A is a perspective view of an exemplary cutter substrate including two intersecting grooves in the substrate end face.
Figure 25C:
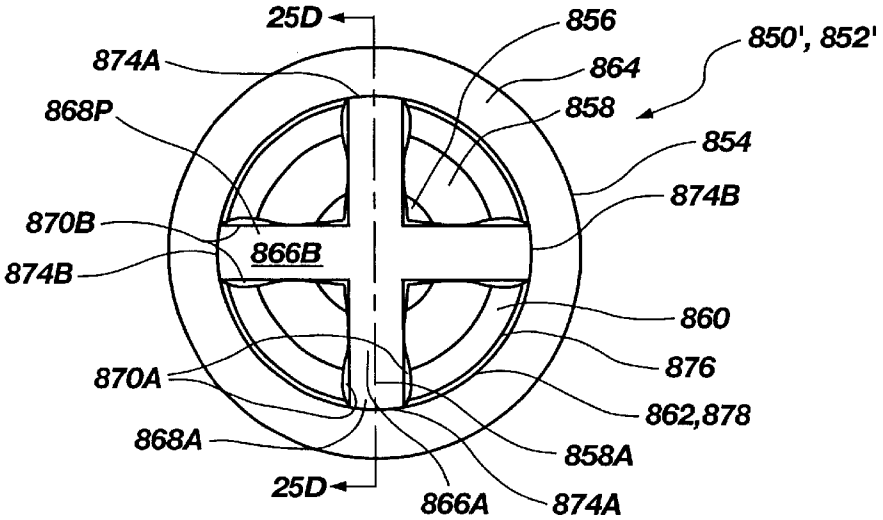
FIG. 25C is a top view of the cutter substrate of FIG. 25A.
Figure 25B:
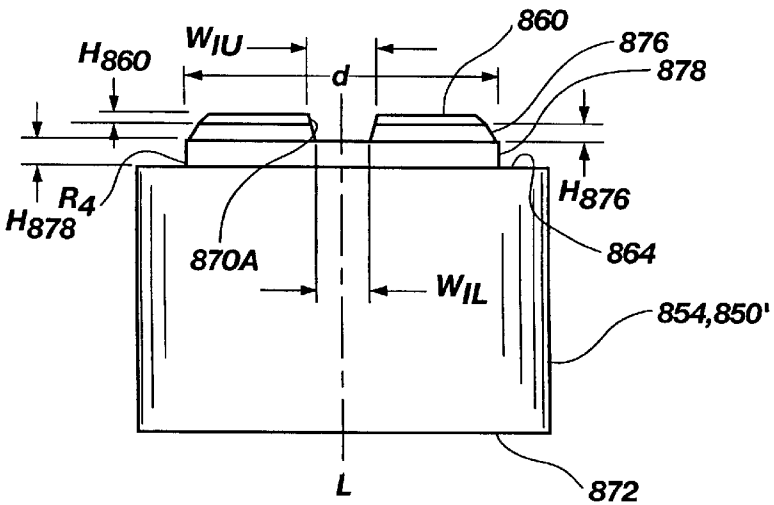
FIG. 25B is a side view of the cutter substrate of FIG. 25A.

Second recessed region 866B preferably traverses or bisects first recessed region 866A at longitudinal centerline L. Furthermore, second recessed region 866B is preferably generally perpendicular to first recessed region 866A, as viewed looking longitudinally downward as depicted in FIGS. 25A and 25C, although the relative angle between the first and second recessed regions can be other than perpendicular or 90° as illustrated. Preferably, the upper and lower widths $W_{1L}$ and $W_{1U}$ are the same for each of the recessed regions or grooves, thereby slightly angling side walls 870A, B slightly radially inward from end face 852, 852' to bottom surface 868, 868'. It should be understood that, although second recessed region 866B has been depicted and described as having generally the same configuration and size as first recessed region 866A, second or additional recessed regions of different configurations and sizes may be employed in accordance with the present invention.

Radially inset side wall 862 of substrate 850', as illustrated, has been provided with an annular chamfer surface 876 having a height $H_{876}$ proximate to third convex surface 860 with the remaining portion 878 of radially inset side wall 862 adjacent annular ledge surface 864 being generally parallel to longitudinal axis or centerline L. Annular chamfered surface 876 is shown as being angled approximately 20° with respect to longitudinal centerline L. Of course, annular chamfered surface 876 may be angled less than or more than the preferred approximate 20° angle and may be used to alleviate the formation of stress concentrations or risers in the proximate region which may induce a crack in substrate 850' or a superabrasive table to ultimately be disposed thereupon. To serve as an example of the preferred relative size of annular chamfered surface 876, a cutter substrate, such as substrate 850' having a diameter D of 0.075 of an inch, can have a height $H_{876}$ of approximately 0.033 of an inch with the remaining portion 878 having a height $H_{878}$ of approximately 0.045 of an inch.

As with substrate 850, the junction of annular ledge surface 864 and radially inset side wall 862 of substrate 850', or more specifically, the bottom remaining portion 878 of radially inset side wall 862, is provided with a small radius of curvature $R_4$. Such radius of curvature $R_4$ can be approximately 0.010–0.020 of an inch with 0.015 of an inch appearing to be well suited for preventing stress concentrations or stress risers thereabout.

Figure 25D:
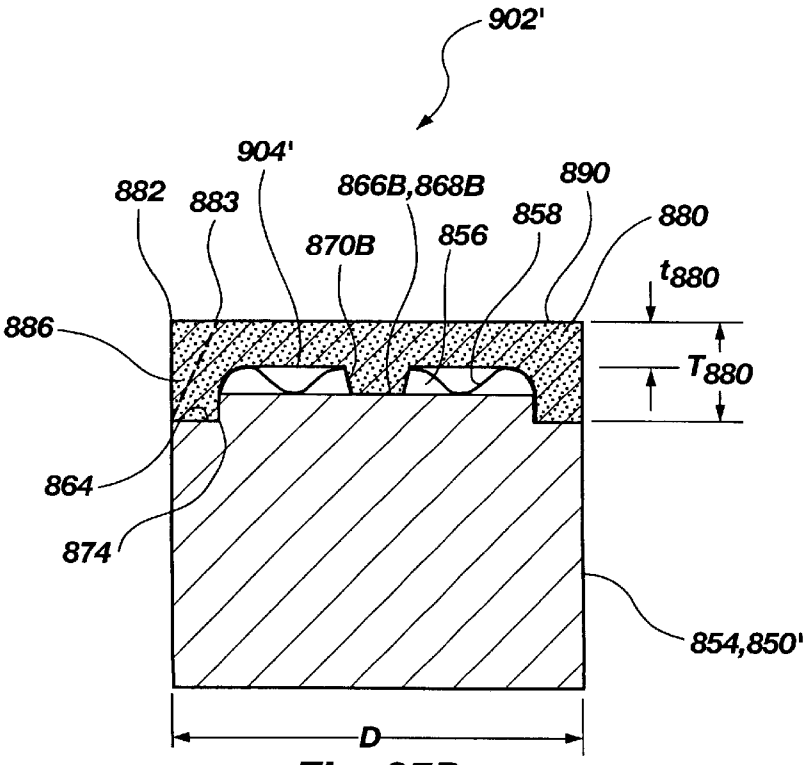
FIG. 25D is a cross-sectional view of the cutter substrate as shown in FIG. 25C having a superabrasive table disposed thereon which includes a wear flat.

As with first recessed region 866A, second recessed region 866B is preferably ground into end face 852' after substrate 850' has been constructed. Grinding is preferred as it is believed to offer enhanced bonding strength between the interior surfaces of the recessed portions and superabrasive material disposed therein upon a volume of superabrasive material being disposed upon end face 852' so as to form a superabrasive table 880 on cutter 902' as shown in FIG. 25D. The exterior surface of table 880 has the same features as described with respect to cutter 902 and a typical wear flat surface 886 is shown in phantom as discussed previously.

FIGS. 26A–26D of the drawings illustrate a yet additional cutter 850" including an end face 852" comprising a preselected topographic configuration including at least one annular arcuate surface and at least one recessed portion in accordance with the present invention. End face 852", in effect, is constructed to include the same features as provided in end face 852 of substrate 850, as previously described and illustrated, with the exception of a plurality of smaller, second recessed regions 894 radially or circumferentially spaced about end face 852" and radially inset side wall 862 comprising an annular chamfered surface 876 as described and illustrated with respect to end face 852' of substrate 850'.

The plurality of the smaller radially extending second recessed regions are preferably spaced diametrically opposite each other so as to be equally radially and angularly or circumferentially spaced from each other and from larger first recessed region 866. In the particular embodiment shown in FIGS. 26A–26 D, second recessed region 894 is angularly spaced from each other at an angle θ of approximately 45° with other angles being suitable as well.

Although end face 852" is shown has having 6 smaller second recessed regions 894, a greater number or lesser number of second recessed regions may be provided. Second recessed regions or grooves 894 are defined by bottom surface 896 and side walls 898. In the particular embodiment illustrated in FIGS. 26A–26D, side walls 898 of second recessed regions 894 are shown as being generally parallel to longitudinal centerline L and, thus, are separated by a constant, slightly smaller width $W_2$ in contrast to the preferred angled side walls of first larger recessed region 866. Width $W_2$ preferably ranges from approximately 0.02 of an inch to approximately 0.08 of an inch, with approximately 0.045 being suitable for many applications. Another difference between second recessed regions or grooves 894 and first recessed region 866 is the substantially shorter radial length $L_2$ as compared to the length of first recessed region 866 preferably being the same length as dimension d. Radial length $L_2$ of second recessed regions 894 preferably ranges from approximately 0.1 inches to approximately 0.2 of an inch, with approximately 0.16 of an inch being suitable for many applications.

Figure 26A:
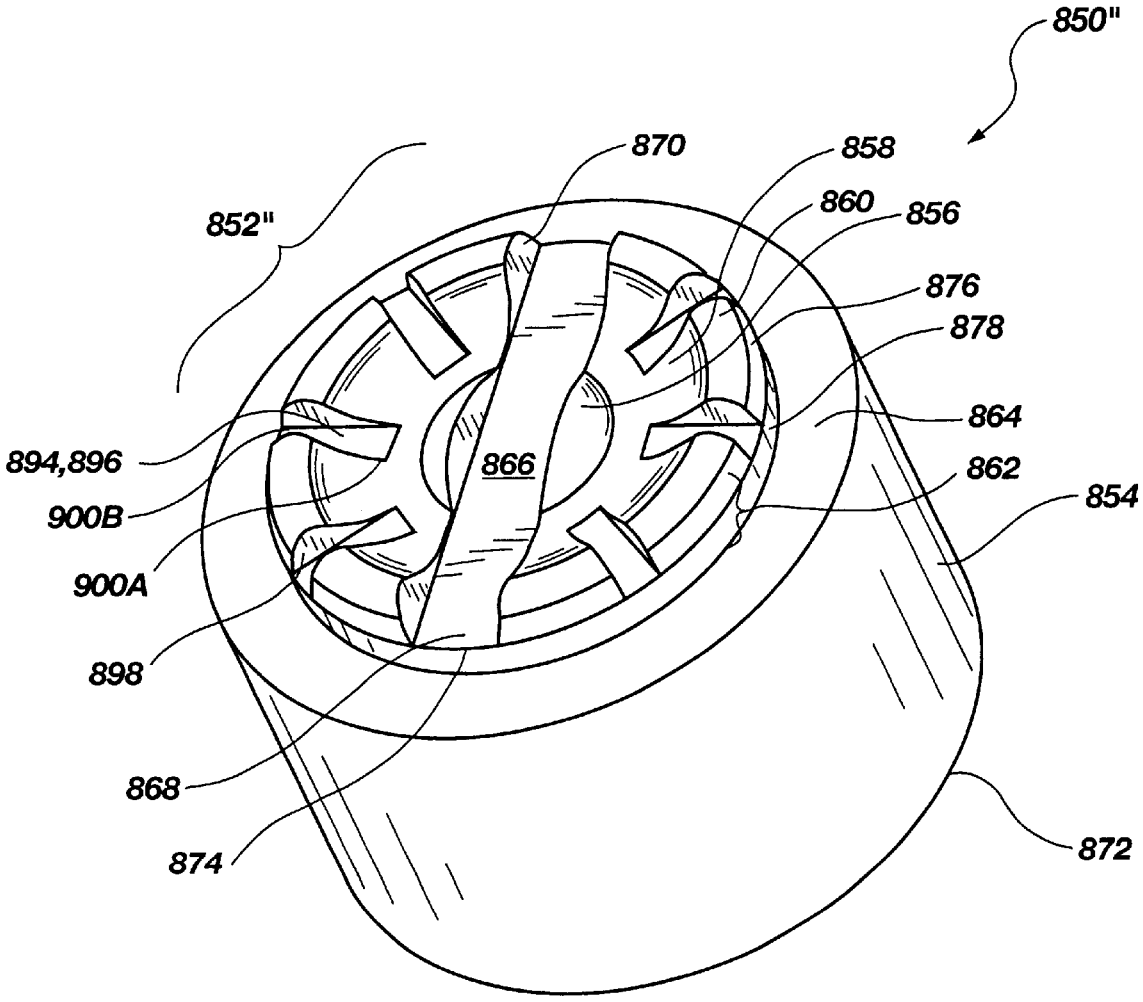
FIG. 26A is a perspective view of an exemplary cutter substrate including one large recessed portion or groove and a plurality of smaller radially oriented recessed portions or grooves in the substrate end face.
Figure 26C:
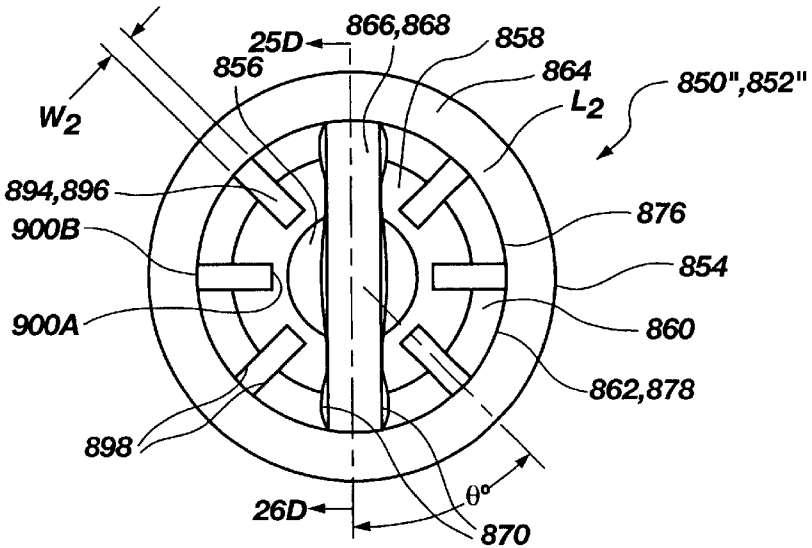
FIG. 26C is a top view of the cutter substrate of FIG. 26A.
Figure 26B:
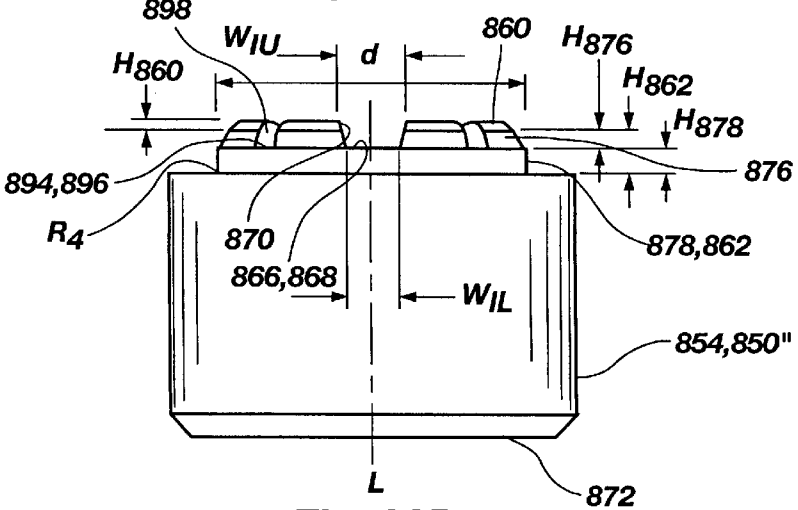
FIG. 26B is a side view of the cutter substrate of FIG. 26A.

As can best be seen in FIGS. 26A and 26C, second recessed regions 894 include a radially innermost end portion 900A positioned in concave surface 858 and a radially outermost end portion 900B positioned to terminate proximate to radially inset side wall 862 so as to be radially short of annular ledge surface 864. Of course, the exact positioning of end portions 900A and 900B can be modified as can the gap between side walls 898 and the longitudinal extent or depth in which side walls 898 extend longitudinally from end face 852" toward substrate bottom surface 872 (first shown in FIG. 24A) in the same manner as first recessed region 866 can be modified to optimize the benefits of the present invention.

Figure 26D:
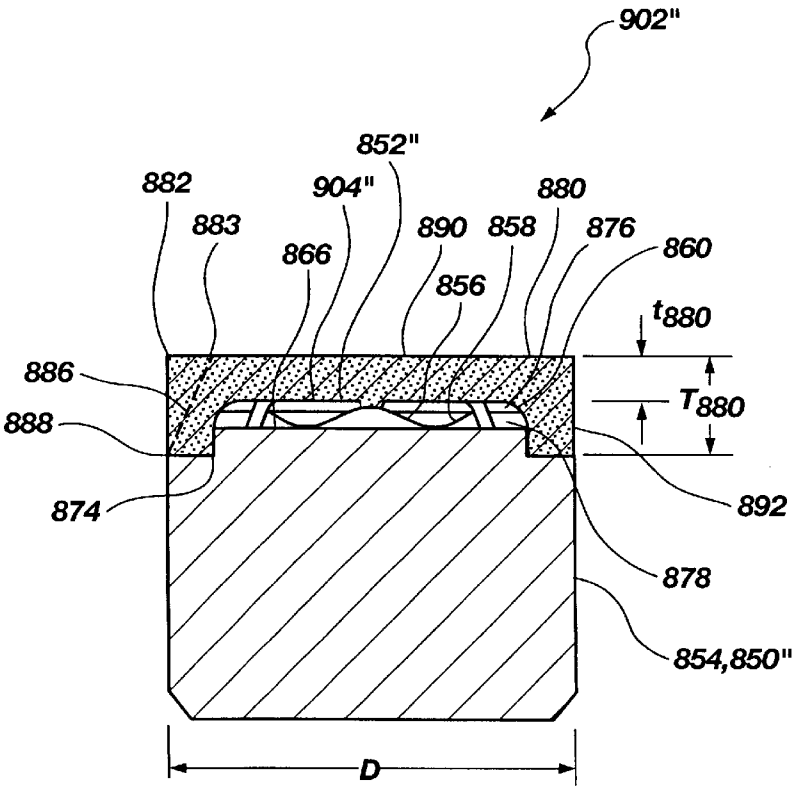
FIG. 26D is a cross-sectional view of the cutter substrate as shown in FIG. 26C having a superabrasive table disposed thereon which includes a wear flat.

FIG. 26D shows a cutter 902" in which a volume of superabrasive material has been disposed upon end face 852" to form a superabrasive table 880 thereon. FIG. 26D also shows the preferred orientation of the first recessed portion 866 with respect to the location in which wear-flat 886 is expected to occur upon cutter 902" being installed in a drill bit and placed into service. That is, as with the other embodiments of the present invention comprising a recessed region in the end face of the substrate, it is preferred that the wear flat be formed radially adjacent an end portion 874 of recessed region or groove 866.

Figure 27:
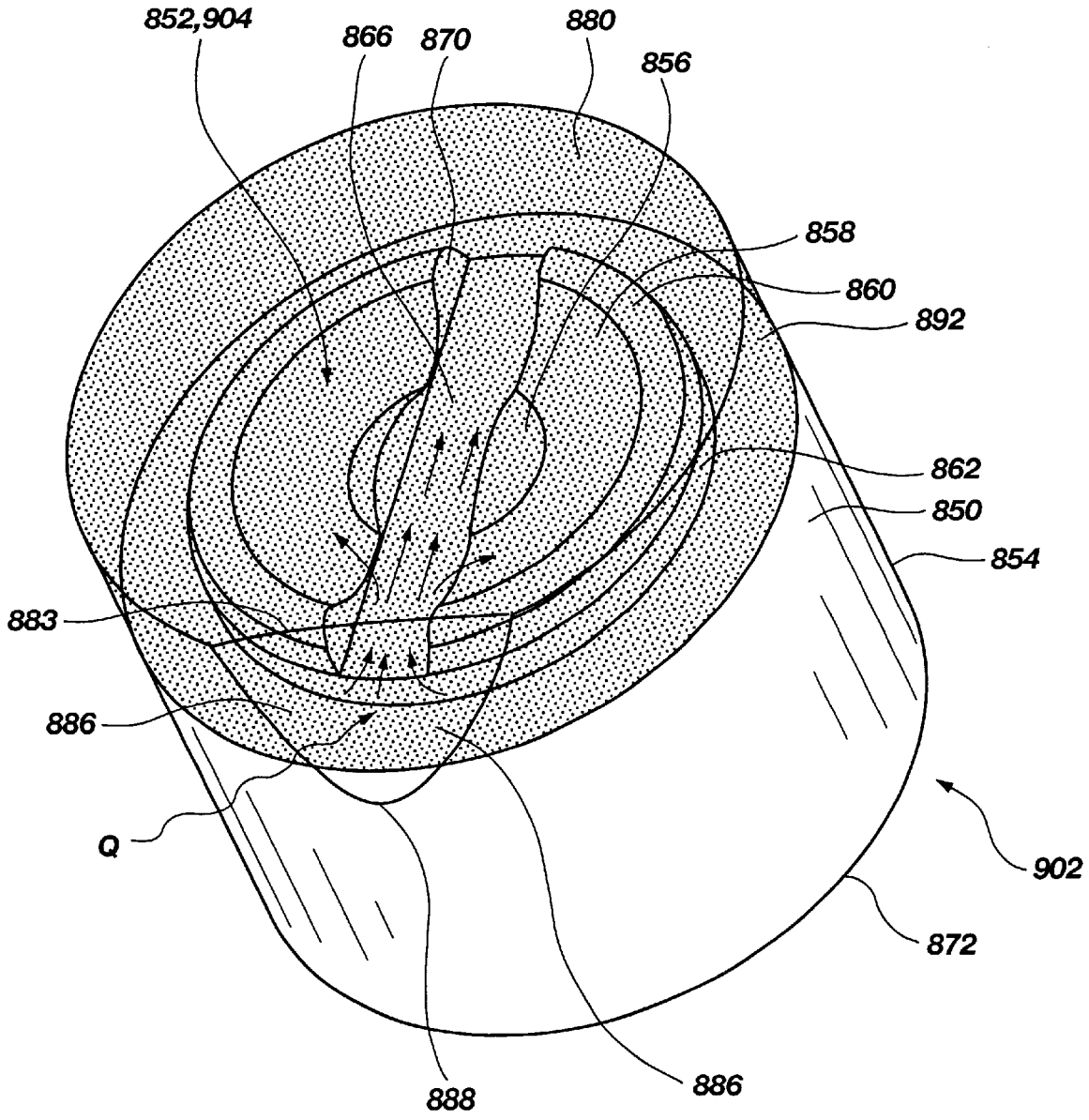
FIG. 27 is a perspective view of a cutter comprising the cutter substrate of FIG. 24A illustrating improved heat conduction away from a wear flat, especially through such portion of the superabrasive table disposed within the groove located on the end face of the substrate.

FIG. 27 provides a perspective view of cutter 902 with superabrasive table 880 shown as being transparent. Wear flat or surface 886 arising from cutter 902 engaging a subterranean formation upon being placed in service as described previously is depicted. It is known that cutters, including cutters 902 and the other cutters disclosed herein and variations thereof, experience a great amount of primarily friction-induced heat Q generated as a result of the friction between the cutter and the formation, as the drill bit in which the cutter is installed engages and removes formation material. Most of the heat Q generated during drilling originates in and about the portion of the cutter which actually engages the formation, which in most instances is the region in which wear-flat or surface 886 is formed. The inventors of the present invention expect thermal testing of cutters embodying the present invention will confirm that heat Q is more efficiently conducted away from wear-flat 886 by virtue of recessed region 866 being filled by superabrasive material of superabrasive table 880. The inventors believe this is attributable to the superabrasive material of table 880 usually having a significantly higher or greater coefficient of thermal conductivity as compared to the coefficient of thermal conductivity of the material in which the supporting substrate 850 is comprised. For example, the coefficient of thermal conductivity of a diamond-based superabrasive table $k_{diamond}$ is often approximately 6 times the coefficient of thermal conductivity of a carbide-based substrate $k_{carbide\ substrate}$, resulting in a relative thermal conductivity ratio of approximately 6:1. Thus, by virtue of the diamond table or "bar" extending into and filling recessed region 866, or a plurality of recessed regions, provided within interface 904 between table 880 and end face 852, heat Q will be conducted more readily along the paths shown by the multiple arrows where the heat can be dissipated over the remaining portion of the cutter, into the face of the drill bit, as well as into the surrounding drilling fluid when the cutter is in operation. Because heat is being more efficiently transferred a way, both radially and upwardly, from the leading most cutting surface 883, as well as wear-flat 886, by virtue of the increased volume of superabrasive material having a larger $k_{diamond}$ being disposed in recessed region 866, cutters incorporating such a recessed region, which is preferably oriented as shown with respect to the portion of the cutter which will primarily engage the formation, are expected to exhibit increased resistance to thermally induced cracks or structure failures. Because heat Q is being conducted away from the wear-flat or active cutting surface of the cutter, as illustrated by the arrows included in FIG. 27 representing exemplary paths in which heat Q will be dissipated, both longitudinally and radially, away from wear flat 886, the cutter should experience fewer localized regions of friction-induced high temperatures or "hot spots" which could jeopardize the strength and integrity of the superabrasive table bonded to the substrate at interface 904 which otherwise would likely lead to unwanted cracks and premature fragmentation of the table and/or cutter when the cutter is placed in service.

Therefore, the present invention, particularly embodiments incorporating at least one recessed portion in the end face of the substrate, provides a cutter having enhanced heat transfer characteristics compared to prior art cutters having conventional interfaces.

It will be understood that the reference to "annular" surfaces herein is not limited to surfaces defining a complete annulus or ring. For example, a partial annulus in the area of the substrate end face oriented to accommodate resultant loading on the cutting edge is contemplated as included in the present invention. Similarly, a discontinuous or segmented annular surface is likewise included. Moreover, an "arcuate" surface topography includes surfaces which curve on a constant radius, such as spherical surfaces of revolution and toroids of circular cross-section, as well as spheroidal surfaces such as those which include components from, for example, two distinct radii about center points, and further include surfaces which are nonlinear but curve on varying, continuously or intermittently variable radii.

While the present invention has been disclosed in terms of certain exemplary embodiments, those of ordinary skill in the art will understand and appreciate that it is not so limited. Many additions, deletions, combinations, and modifications to the invention as disclosed herein may be effected without departing from the spirit and scope of the invention as claimed.

What is claimed is:

1. for drilling a subterranean formation, comprising:

a substrate having a longitudinal centerline, a radially outermost side wall, a substantially circular end face, and a substantially circular bottom face, the end face comprising, as taken in radial cross-section longitudinally parallel to the longitudinal centerline:

a preselected topographic configuration including a first annular arcuate surface exhibiting a convex shape defined by a spherical surface of revolution having a center point coincident to the longitudinal centerline; a second annular arcuate surface exhibiting a concave partial surface of a first toroid having a center point radially offset from the longitudinal centerline; a third annular arcuate surface exhibiting a convex partial surface of a second toroid having a center point radially offset from the longitudinal centerline; an annular radially inset side wall surface extending generally vertically downward from the third annular arcuate surface; an annular ledge surface extending generally perpendicular to the longitudinal centerline, and extending radially outwardly from the annular radially inset side wall surface to the radially outermost sidewall; and at least one first recessed region extending generally transversely to the longitudinal centerline; and a volume of superabrasive material disposed over the end face, the volume of superabrasive material comprising a cutting face longitudinally spaced from the substrate end face and the cutting face having a peripheral edge.

2. The cutter of claim 1, wherein the at least one first recessed region extends generally diametrically across the end face and comprises oppositely positioned end regions radially proximate the annular ledge surface, a bottom surface defining a lower width of the at least one first recessed region, and at least two opposing side surfaces extending from an end surface of the substrate and terminating at the generally planar bottom surface of the at least one first recessed region.

3. The cutter of claim 2, wherein the bottom surface of the at least one first recessed region is positioned longitudinally above the annular ledge surface.

4. The cutter of claim 3, wherein the at least two opposing side surfaces of the at least one first recessed region are sloped with respect to the longitudinal centerline so as to provide an upper width of the at least one first recessed region dimensionally exceeding the lower width of the at least one first recessed region.

5. The cutter of claim 4, wherein the radially inset side wall surface includes a radially outwardly facing annular chamfered surface.

6. The cutter of claim 2, wherein the at least one first recessed region comprises at least two recessed regions intersecting each other proximate the longitudinal centerline.

7. The cutter of claim 6, wherein two of the at least two recessed regions are oriented generally perpendicular to each other.

8. The cutter of claim 1, wherein the at least one first recessed region extends through each of the first, second and third annular arcuate surfaces and stops radially short of the annular ledge surface.

9. The cutter of claim 8, wherein the at least one first recessed region comprises at least two recessed regions intersecting each other proximate the longitudinal centerline, each of the at least two recessed regions stopping radially short of the annular ledge surface.

10. The cutter of claim 9, wherein the radially inset side wall surface includes a radially outwardly facing annular chamfered surface.

11. The cutter of claim 10, wherein the radially inset side wall surface includes an annular portion extending generally parallel to the longitudinal centerline and positioned longitudinally below the radially outwardly facing annular chamfered surface.

12. The cutter of claim 1, wherein the radially inset side wall surface and the annular ledge surface have a radiused junction.

13. The cutter of claim 1, wherein the radially inset side wall surface is generally parallel to the longitudinal centerline.

14. The cutter of claim 1, wherein the end face comprises at least one second recessed region having a bottom surface defining a lower width, the lower width of the at least one second recessed region being dimensionally less than the lower width of the at least one first recessed region.

15. The cutter of claim 14, wherein the at least one second recessed region comprises a radially innermost end region positioned radially outwardly from the first annular arcuate surface and a radially outermost end region positioned radially inward of the annular ledge surface.

16. The cutter of claim 15, wherein the bottom surface of the at least one second recessed region is positioned longitudinally above the annular ledge surface.

17. The cutter of claim 16, wherein the at least one second recessed region comprises a plurality of circumferentially spaced second recessed regions.

18. The cutter of claim 17, wherein the at least one first recessed region bisects a substantial portion of the end face and approximately an equal number of the plurality of second recessed regions are positioned opposite each other with respect to the at least one first recessed region.

19. The cutter of claim 17, wherein the radially inset side wall surface comprises an annular chamfered portion positioned adjacent the third annular arcuate surface and a second surface portion generally parallel to the longitudinal centerline and positioned longitudinally below a radially outwardly facing annular chamfered surface and adjacent the annular ledge surface.

20. The cutter of claim 17, further comprising the radially inset side wall surface and the annular ledge surface having a radiused junction.

21. A drill bit for drilling a subterranean formation, comprising:

a bit body having a face at one end thereof and a structure at the opposite end thereof for connecting the bit to a drill string;

at least one cutter mounted to the bit body over the bit face, the at least one cutter comprising a substrate having a longitudinal centerline, a radially outermost side wall, a substantially circular end face, and a substantially circular bottom face, the end face comprising, as taken in radial cross-section longitudinally parallel to the longitudinal centerline:

a preselected topographic configuration including a first annular arcuate surface exhibiting a convex shape defined by a spherical surface of revolution having a center point coincident to the longitudinal centerline; a second annular arcuate surface exhibiting a concave partial surface of a first toroid having a center point radially offset from the longitudinal centerline; a third annular arcuate surface exhibiting a convex partial surface of a second toroid having a center point radially offset from the longitudinal centerline; an annular radially inset side wall surface extending generally vertically downward from the third annular arcuate surface; an annular ledge surface extending generally perpendicular to the longitudinal centerline and extending radially outwardly from the annular radially inset side wall surface to the radially outermost sidewall; and at least one first recessed region extending generally transversely to the longitudinal centerline; and a volume of superabrasive material disposed over the end face of the substrate, the volume of superabrasive material comprising a cutting face longitudinally spaced from the substrate end face and the cutting face having a peripheral edge.

22. The drill bit of claim 21, wherein the at least one first recessed region of the substrate extends generally diametrically across the end face and comprises oppositely positioned end regions radially proximate the annular ledge surface, a bottom surface defining a lower width of the at least one first recessed region, and at least two opposing side surfaces extending from an end surface of the substrate and terminating at the generally planar bottom surface of the at least one first recessed region.

23. The drill bit of claim 22, wherein the bottom surface of the at least one first recessed region of the substrate is positioned longitudinally above the annular ledge surface.

24. The drill bit of claim 23, wherein the at least two opposing side surfaces of the at least one first recessed region of the substrate are sloped with respect to the longitudinal centerline so as to provide an upper width of the at least one first recessed region dimensionally exceeding the lower width of the at least one first recessed region.

25. The drill bit of claim 24, wherein the radially inset side wall surface of the substrate includes a radially outwardly facing annular chamfered surface.

26. The drill bit of claim 22, wherein the at least one first recessed region of the substrate comprises at least two recessed regions intersecting each other proximate the longitudinal centerline.

27. The drill bit of claim 26, wherein two of the at least two recessed regions of the substrate are oriented generally perpendicular to each other.

28. The drill bit of claim 21, wherein the at least one first recessed region of the substrate extends through each of the first, second and third annular arcuate surfaces and stops radially short of the annular ledge surface.

29. The drill bit of claim 28, wherein the at least one first recessed region of the substrate comprises at least two recessed regions intersecting each other proximate the longitudinal centerline, each of the at least two recessed regions stopping radially short of the annular ledge surface.

30. The drill bit of claim 29, wherein the radially inset side wall surface of the substrate includes a radially outwardly facing annular chamfered surface.

31. The drill bit of claim 30, wherein the radially inset side wall surface of the substrate includes an annular portion extending generally parallel to the longitudinal centerline and positioned longitudinally below the radially outwardly facing annular chamfered surface.

32. The drill bit of claim 21, wherein the radially inset side wall surface and the annular ledge surface of the substrate have a radiused junction.

33. The drill bit of claim 21, wherein the radially inset side wall surface of the substrate is generally parallel to the longitudinal centerline.

34. The drill bit of claim 21, wherein the end face of the substrate comprises at least one second recessed region having a bottom surface defining a lower width, the lower width of the at least one second recessed region being dimensionally less than the lower width of the at least one first recessed region.

35. The drill bit of claim 34, wherein the at least one second recessed region of the substrate comprises a radially innermost end region positioned radially outwardly from the first annular arcuate surface and a radially outermost end region positioned radially inward of the annular ledge surface.

36. The drill bit of claim 35, wherein the bottom surface of the at least one second recessed region is positioned longitudinally above the annular ledge surface.

37. The drill bit of claim 36, wherein the at least one second recessed region of the substrate comprises a plurality of circumferentially spaced second recessed regions.

38. The drill bit of claim 37, wherein the at least one first recessed region of the substrate bisects a substantial portion of the end face and approximately an equal number of the plurality of second recessed regions of the substrate are positioned opposite each other with respect to the at least one first recessed region.

39. The drill bit of claim 37, wherein the radially inset side wall surface of the substrate comprises an annular chamfered portion positioned adjacent the third annular arcuate surface and a second surface portion generally parallel to the longitudinal centerline and positioned longitudinally below a radially outwardly facing annular chamfered surface and adjacent the annular ledge surface.

40. The drill bit of claim 37, further comprising the radially inset side wall surface and the annular ledge surface of the substrate having a radiused junction.

41. The drill bit of claim 21, wherein the at least one cutter mounted to the bit body over the bit face comprises a plurality of cutters mounted to the bit body over the bit face, each of the plurality of cutters being mounted at a preselected cutter backrake angle.

42. A cutter for drilling a subterranean formation, comprising:

a substrate having a longitudinal centerline, a radially outermost side wall, a substantially circular end face, and a substantially circular bottom face, the end face comprising, as taken in radial cross-section longitudinally parallel to the longitudinal centerline:

a preselected topographic configuration including a first annular arcuate surface exhibiting a convex shape defined by a spherical surface of revolution having a center point coincident to the longitudinal centerline; a second annular arcuate surface exhibiting a concave partial surface of a first toroid having a center point radially offset from the longitudinal centerline; a third annular arcuate surface exhibiting a convex partial surface of a second toroid having a center point radially offset from the longitudinal centerline; an annular radially inset side wall surface extending generally vertically downward from the third annular arcuate surface; and an annular ledge surface extending generally perpendicular to the longitudinal centerline and extending radially outwardly from the annular radially inset side wall surface to the radially outermost sidewall; and a volume of superabrasive material disposed over the end face, the volume of superabrasive material comprising a cutting face longitudinally spaced from the substrate end face and the cutting face having a peripheral edge.

43. The cutter of claim 42, wherein the radially inset side wall surface includes a radially outwardly facing annular chamfered surface.

44. The cutter of claim 43, wherein the radially inset side wall surface includes an annular portion extending generally parallel to the longitudinal centerline and positioned longitudinally below the radially outwardly facing annular chamfered surface.

45. The cutter of claim 42, wherein the radially inset side wall surface and the annular ledge surface have a radiused junction.

46. The cutter of claim 42, wherein the radially inset side wall surface is generally parallel to the longitudinal centerline.

47. A drill bit for drilling a subterranean formation, comprising:

a bit body having a face at one end thereof and a structure at the opposite end thereof for connecting the bit to a drill string;

at least one cutter mounted to the bit body over the bit face, the at least one cutter comprising a substrate having a longitudinal centerline, a radially outermost side wall, a substantially circular end face, and a substantially circular bottom face, the end face comprising, as taken in radial cross-section longitudinally parallel to the longitudinal centerline:

a preselected topographic configuration including a first annular arcuate surface exhibiting a convex shape defined by a spherical surface of revolution having a center point coincident to the longitudinal centerline; a second annular arcuate surface exhibiting a concave partial surface of a first toroid having a center point radially offset from the longitudinal centerline; a third annular arcuate surface exhibiting a convex partial surface of a second toroid having a center point radially offset from the longitudinal centerline; an annular radially inset side wall surface extending generally vertically downward from the third annular arcuate surface; an annular ledge surface extending generally perpendicular to the longitudinal centerline and extending radially outwardly from the annular radially inset side wall surface to the radially outermost side wall; and a volume of superabrasive material disposed over the end face of the substrate, the volume of superabrasive material comprising a cutting face longitudinally spaced from the substrate end face and the cutting face having a peripheral edge.

48. The drill bit of claim 47, wherein the radially inset side wall surface includes a radially outwardly facing, annular chamfered surface.

49. The drill bit of claim 48, wherein the radially inset side wall surface includes an annular portion extending generally parallel to the longitudinal centerline and positioned longitudinally below the radially outwardly facing annular chamfered surface.

50. The drill bit of claim 47, wherein the radially inset side wall surface and the annular ledge surface have a radiused junction.

51. The drill bit of claim 47, wherein the radially inset side wall surface is generally parallel to the longitudinal centerline.

* * * * *